US005102779A

United States Patent [19]

Kojima et al.

[11] Patent Number: 5,102,779

[45] Date of Patent: Apr. 7, 1992

[54] METHOD FOR PROCESSING SILVER HALIDE PHOTOGRAPHIC MATERIALS, AND DEVELOPER AND SILVER HALIDE PHOTOGRAPHIC MATERIAL USED THEREIN

[75] Inventors: Tetsuro Kojima; Eiichi Okutsu; Kazunobu Katoh, all of Kanagawa, Japan

[73] Assignee: Fuji Photo Film Co., Ltd., Kanagawa, Japan

[21] Appl. No.: 596,272

[22] Filed: Oct. 12, 1990

[30] Foreign Application Priority Data

Oct. 13, 1989 [JP] Japan ..... 1-266592
Jul. 3, 1990 [JP] Japan ..... 2-176164

[51] Int. Cl.[5] ..... G03C 5/26

[52] U.S. Cl. ..... 430/486; 430/264; 430/434; 430/464; 430/484

[58] Field of Search ..... 430/399, 439, 440, 442, 430/480, 482, 483, 484, 485, 490, 493, 264, 434, 464, 486

[56] References Cited

U.S. PATENT DOCUMENTS

| | | | |
|---|---|---|---|
| 2,937,087 | 5/1960 | Fosgard | 430/599 |
| 3,345,175 | 10/1967 | Hayakawa | 430/564 |
| 3,969,117 | 7/1976 | Sakai et al. | 430/266 |
| 4,011,082 | 3/1977 | Sakai et al. | 430/302 |
| 4,221,857 | 9/1980 | Okutsu et al. | 430/264 |
| 4,332,878 | 6/1982 | Akimura et al. | 430/485 |
| 4,636,456 | 1/1987 | Takahashi et al. | 430/485 |
| 4,740,452 | 4/1988 | Okutsu et al. | 430/490 |
| 4,774,169 | 9/1988 | Kuse et al. | 430/399 |
| 4,833,068 | 5/1989 | Ohki et al. | 430/484 |
| 4,975,354 | 12/1990 | Machonkin et al. | 430/264 |

FOREIGN PATENT DOCUMENTS

| | | |
|---|---|---|
| 0203521 | 12/1986 | European Pat. Off. . |
| 0364166 | 4/1990 | European Pat. Off. . |

*Primary Examiner*—Hoa Van Le
*Attorney, Agent, or Firm*—Sughrue, Mion, Zinn, Macpeak & Seas

[57] ABSTRACT

A method for processing silver halide photographic materials comprising the step of: processing imagewise exposed silver halide photographic material using a developer containing at least one compound represented by general formula (X):

(X)

wherein $R_1$ and $R_2$ each represents a hydrogen atom, an alkyl group containing from 2 to 8 carbon atoms, an alkenyl group containing from 3 to 8 carbon atoms, or an aralkyl group containing from 7 to 12 carbon atoms; or $R_1$ and $R_2$ are combined to form a ring; $R_3$, $R_4$, $R_5$, and $R_6$ each represents a hydrogen atom, or an alkyl group containing from 1 to 4 carbon atoms: and n represents an integer from 3 to 20. A developer for processing silver halide photographic materials comprising at least one compound represented by general formula (X), described above. A silver halide photographic material comprising: at least one compound represented by general formula (X'):

(X')

wherein $R'_1$ and $R'_2$ each represents a hydrogen atom, an alkyl group containing from 1 to 30 carbon atoms, an alkenyl group containing from 3 to 30 carbon atoms, or an aralkyl group containing from 7 to 30 carbon atoms; or $R'_1$ and $R'_2$ are combined to form a ring; $R_3$, $R_4$, $R_5$, and $R_6$ are the same as described above; and n' represents an integer from 2 to 50. A method for processing silver halide photographic materials comprising the step of: processing imagewise exposed silver halide photographic material comprising at least one compound represented by general formula (X'), described above.

15 Claims, No Drawings

METHOD FOR PROCESSING SILVER HALIDE PHOTOGRAPHIC MATERIALS, AND DEVELOPER AND SILVER HALIDE PHOTOGRAPHIC MATERIAL USED THEREIN

FIELD OF THE INVENTION

This invention relates to a method for the development-processing of silver halide photographic materials and, more particularly, to a method for accelerating development in a developing step to effectively increase sensitivity.

Further, the invention relates to a method for developing high-contrast silver halide photographic materials in the presence of a hydrazine derivative to form high contrast negative images suitable for photomechanical processes in the graphic arts.

BACKGROUND OF THE INVENTION

A variety of methods for accelerating development, or shortening the time necessary for attaining prescribed photographic characteristics are known such as adding various compounds or development accelerators, to a developer. Such methods are disclosed in U.S. Pat. Nos. 3,746,545, 4,072,523, 4,072,526, and 4,145,218.

However, these methods either produce insufficient development acceleration or produce sufficient development acceleration accompanied by the generation of fog.

High contrast photographic characteristics are required to reproduce continuous-tone images or line images using halftone dots in graphic art image-forming systems. At present, this is done with a lith developer containing hydroquinone as the only developing agent, and a sulfite preservative in the form of a formaldehyde adduct in order to reduce the free sulfite ion concentration as much as possible because sulfite ion inhibits the infectious developability of hydroquinone. Consequently, this lith developer is extremely susceptible to air oxidation, and cannot be preserved more than 3 days.

A number of methods have been proposed to obtain high contrast photographic characteristics using a stable developer, e.g., U.S. Pat. Nos. 4,224,401, 4,168,977, 4,166,742, 4,311,781, 4,272,606, 4,211,857, and 4,243,739. According to these methods, extremely high contrast and high sensitivity characteristics can be achieved. In addition, sulfite can be used at high concentration, thus greatly enhancing the stability of the developer to air oxidation compared to lith developer. However, the pH of the developer used in these methods is much greater than that of a lith developer, and subject to variations. Because of this, these methods all have a problem that the photographic characteristics are apt to vary.

With the intention of solving the above-described problem, U.S. Pat. No. 4,269,929, JP-A-61-230145, JP-A-63-503247, JP-A-60-258537, JP-A-60-218642, JP-A-60-129746, JP-A-61-251846, JP-A-1-205160, JP-A-1-214844, and JP-A-1-200354 (the term "JP-A" as used herein means an "unexamined published Japanese patent application") disclose the addition of an amino compound to an alkaline developer containing dihydroxybenzene as a developing agent. The amino compound heightens the activity of the developer so that the sensitizing and contrast-increasing effects of hydrazine derivatives are made to manifest at a lower pH, which does not effectively prevent variation in photographic characteristics under ordinary conditions.

Unfortunately, amino compounds can act as a silver halide solvent (cf., C.E.K. Mees, *The Theory of the Photographic process*, 3rd. Ed., p. 370, and L.F.A. Mason, *Photographic Processing Chemistry*, p. 43). Therefore, the developing method disclosed by the above-cited U.S. Patent in which an amino compound is used in quantity, tends to cause "silver stain". (The term "silver stain" as used herein refers to a defect in a processing system using an automatic developing machine where replenisher is supplied to a developing tank based on the area of silver halide photographic film processed. In such a system, silver halide eluted from the film by the developer is deposited and accumulates as silver on the wall of the developing tank and on the film-conveying rollers, from where it is transferred onto films being developed.)

With the intention of overcoming silver stain, JP-A-61-67759 and JP-A-62-211647 disclose amino compounds that increase contrast without acting as a silver solvent.

A silver halide photographic material utilizing paper as a support (including a light-sensitive material for block copy and a light-sensitive material for photocomposition, hereinafter referred to a "photographic paper") and high contrast photographic material are needed to completely process graphic arts film. (The expression "utilizing paper as a support" used herein is intended to include the so-called resin-coated paper, or paper coated with polyolefin on one side or both sides.)

Up until now, such light-sensitive materials have been processed using individualized developers tailored for exclusive use, with a particular light-sensitive material. However, it is undesirable to set up automatic developing machines using a large variety of exclusive developers due to the great cost of equipment and unkeep.

Thus, a developer is desired for both a light-sensitive material having a paper support and a high contrast light-sensitive material suitable for photographing line originals or halftone images.

The developer containing an amino compound that does not cause silver stain, unfortunately causes color stain because it penetrates a light-sensitive material on a paper support via its cut end. Accordingly, there is a demand for developers that have a contrast-increasing effect and avoid color stain of the photographic paper as well as the other problems discussed above.

An attempt was made to incorporate the amino compounds of the references discussed above into a silver halide photographic material in order to further accelerate development. However, the developed photographic material underwent significant deterioration over time.

Obviously, there still exists a great need for compounds that can simultaneously ensure development acceleration and storage stability of the light-sensitive material.

In the grapic arts, a method of incorporating an amino compound into a hydrazine derivative-containing silver halide photographic material in order to form a high contrast photographic image is known, and disclosed, e.g., in JP-A-60-140340, JP-A-61-251846, JP-A-62-222241, JP-A-63-124045, JP-A-61-230145, JP-A-01-179939, JP-A-01-179940, and European Patent 364,166. However, the amino compounds described in these patents do not increase the contrast nor the storage stability sufficiently.

SUMMARY OF THE INVENTION

Therefore, one object of this invention is to provide a processing method that prevents the generation of fog and greatly accelerates development.

Another object of this invention is to provide a developer that accelerates development without increasing fog.

A further object of this invention is to provide a processing method which enables the formation of photographic images on high contrast negatives having reduced silver stain in the presence of a hydrazine derivative and to provide a processing method which enables the reduction of .color stain in photographic paper developed with the same developer as for a high contrast light-sensitive material, and a developer to be used therein.

Yet another object of this invention is to provide a silver halide photographic material and a method of processing this material which ensures development acceleration and high storage stability.

These and other objects of the invention are satisfied by a method for processing silver halide photographic materials comprising the step of: processing imagewise exposed silver halide photographic material using a developer containing at least one compound represented by general formula (X):

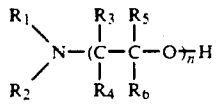

(X)

wherein $R_1$ and $R_2$ each represents a hydrogen atom, an alkyl group containing from 2 to 8 carbon atoms, an alkenyl group containing from 3 to 8 carbon atoms, or an aralkyl group containing from 7 to 12 carbon atoms, provided that $R_1$ and $R_2$ are not both hydrogen atoms; or $R_1$ and $R_2$ are combined to form a ring;

$R_3$, $R_4$, $R_5$, and $R_6$ each represents a hydrogen atom, or an alkyl group containing from 1 to 4 carbon atoms; and n represents an integer from 3 to 20.

These objects are also satisfied by a developer for processing silver halide photographic materials, comprising at least one compound represented by general formula (X):

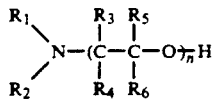

(X)

wherein $R_1$ and $R_2$ each represents a hydrogen atom, an alkyl group containing from 2 to 8 carbon atoms, an alkenyl group containing from 3 to 8 carbon atoms, or an aralkyl group containing from 7 to 12 carbon atoms, provided that $R_1$ and $R_2$ are not both hydrogen atoms or $R_1$ and $R_2$ are combined to form a ring;

$R_3$, $R_4$, $R_5$, and $R_6$ each represents a hydrogen atom or an alkyl group containing from 1 to 4 carbon atoms; and n represents an integer from 3 to 20.

Further, the invention is also satisfied by a silver halide photographic material comprising at least one compound represented by general formula (X'):

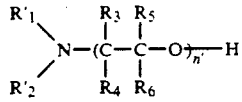

(X')

wherein $R'_1$ and $R'_2$ each represents a hydrogen atom, an alkyl group containing from 1 to 30 carbon atoms, an alkenyl group containing from 3 to 30 carbon atoms, or an aralkyl group containing from 7 to 30 carbon atoms, provided that the total number of carbon atoms contained in $R'_1$ and $R'_2$ together amounts to 10 or more in all when both are alkyl groups and $R'_1$ and $R'_2$ are not both hydrogen atoms; or $R'_1$ and $R'_2$ are combined to form a ring;

$R_3$, $R_4$, $R_5$, and $R_6$ each represents a hydrogen atom or an alkyl group containing from 1 to 4 carbon atoms; and n' represents an integer from 2 to 50.

Further, the invention is also satisfied by a method for processing silver halide photographic materials comprising the step of: processing imagewise exposed silver halide photographic material comprising at least one compound represented by general formula (X'):

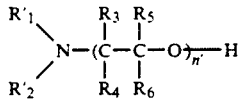

(X')

wherein $R'_1$ and $R'_2$ each represents a hydrogen atom, an alkyl group containing from 1 to 30 carbon atoms, an alkenyl group containing from 3 to 30 carbon atoms, or an aralkyl group containing from 7 to 30 carbon atoms, provided that .the total number of carbon atoms contained in $R'_1$ and $R'_2$ together amounts to 10 or more in all when both are alkyl groups and $R'_1$ and $R'_2$ are not both hydrogen atoms; or $R'_1$ and $R'_2$ are combined to form a ring;

$R_3$, $R_4$, $R_5$, and $R_6$ each represents a hydrogen atom or an alkyl group containing from 1 to 4 carbon atoms; and n' represents an integer from 2 to 50.

DETAILED DESCRIPTION OF THE INVENTION

The compounds represented by the general formula (X) are described below in detail.

$R_1$ and $R_2$ may be the same or different, and they each represents a hydrogen atom, an alkyl group containing from 2 to 8 carbon atoms including substituted ones (e.g., ethyl, n-propyl, iso-propyl, n-butyl, n-hexyl, n-octyl, 2-ethylhexyl, methoxyethyl, ethoxyethyl, ethylthioethyl, dimethylaminoethyl); an alkenyl group containing from 3 to 8 carbon atoms including substituted ones (e.g., allyl, butenyl); or an aralkyl group containing from 7 to 12 carbon atoms including substituted ones (e.g., benzyl, phenethyl, 4-methoxybenzyl).

Further, $R_1$ and $R_2$ may be joined and converted to an optionally substituted alkylene group, and joined to form a ring containing the nitrogen atom to which they are attached (such as a pyrrolidine ring, a piperidine ring, a 2-methylpiperidine ring, a hexamethyleneimine ring).

$R_3$, $R_4$, $R_5$ and $R_6$ may be the same or different, and each represents a hydrogen atom, a lower alkyl group containing from 1 to 4 carbon atoms (preferably one which does not contain any substituent group, e.g., methyl, ethyl, n-propyl).

Examples of suitable substituents for $R_1$ and $R_2$ are a halogen atom (e.g., chlorine, bromine); a cyano group; a nitro group; a hydroxyl group; an alkoxy group (e.g., methoxy); an aryloxy group (e.g., phenoxy, 2,4-di-t-amylphenoxy); an alkylthio group (e.g., methylthio); an arylthio group (e.g., phenylthio); an acyloxy group (e.g., acetyloxy, benzoyloxy); an amino group (e.g., unsubstituted amino, dimethylamino); a carbonamido group (e.g., acetamido); a sulfonamido group (e.g., methanesulfonamido, benzenesulfonamido); an oxycarbonylamino group (e.g., methoxycarbonylamino); an ureido group (e.g., unsubstituted ureido, 3,3-dimethylureido); a thioureido group (e.g., unsubstituted ureido, 3-phenylthioureido); an acyl group (e.g., acetyl, benzoyl); an oxycarbonyl group (e.g., methoxycarbonyl); a carbamoyl group (e.g., methylcarbamoyl, 4-methylphenylcarbamoyl); a sulfonyl group (e.g., methanesulfonyl); a sulfamoyl group (e.g., methylsulfamoyl, 4-methoxyphenylsulfamoyl); a carboxyl group; a carboxylate group; a sulfo group; or a sulfonate group.

It is preferred that both $R_1$ and $R_2$ represent an alkyl group containing from 2 to 4 carbon atoms; $R_3$, $R_4$, $R_5$, and $R_6$ represent a hydrogen atom; and n represents an integer of 3 to 5.

The compounds represented by general formula (X') are described below in detail.

$R_1'$ and $R_2'$ may be the same or different, and they each represents a hydrogen atom, an alkyl group containing from 1 to 30 carbon atoms including substituted ones (e.g., methyl, ethyl, n-butyl, n-hexyl, n-octyl, 2-ethylhexyl, methoxyethyl, ethoxyethyl, dimethylaminoethyl, n-decyl, n-dodecyl, phenoxyethyl, 2,4-di-t-amylphenoxyethyl, n-octadecyl); an alkenyl group containing from 3 to 30 carbon atoms including substituted ones (e.g., allyl, butenyl, pentenyl); or an aralkyl group containing from 7 to 30 carbon atoms including substituted ones (e.g., phenethyl, benzyl, 4-methoxybenzyl, 4-t-butylbenzyl, 2,4-di-t-amylphenethyl).

Examples of substituent for $R_1'$ and $R_2'$ are the same as $R_1$ and $R_2$.

It is preferred that $R_1'$ and $R_2'$ each represents an alkyl group containing from 1 to 30 carbon atoms or an aralkyl group containing from 7 to 30 carbon atoms; $R_3$, $R_4$, $R_5$ and $R_6$ each represents a hydrogen atom; and n' represent an integer from 3 to 20.

In the general formula (X'), it is more preferred that $R_1'$ and $R_2'$ each represents an alkyl group containing from 5 to 20 carbon atoms.

Specific examples of the compounds represented by general formula (X) are illustrated below. However, this invention should not be construed as being limited to these examples.

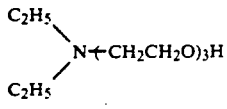
X-1

-continued

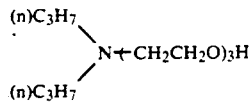
X-2

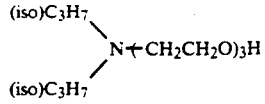
X-3

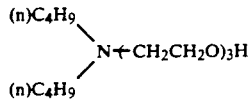
X-4

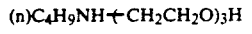
X-5

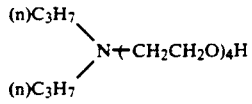
X-6

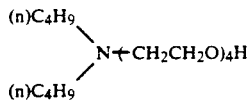
X-7

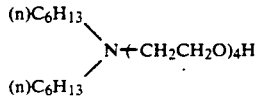
X-8

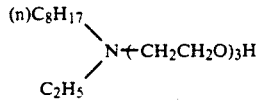
X-9

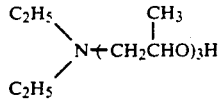
X-10

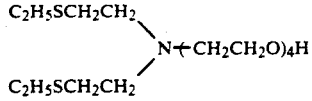
X-11

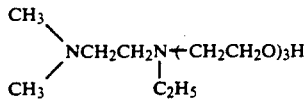
X-12

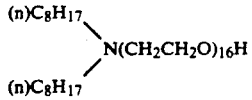
X-13

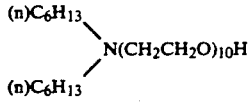
X-14

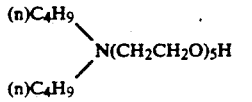
X-15

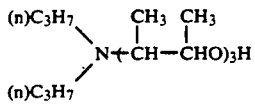
X-16

-continued
X-17
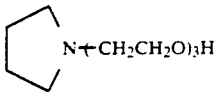
X-18
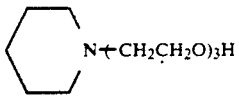
X-19
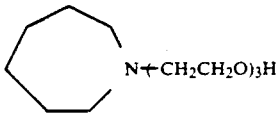
X-20
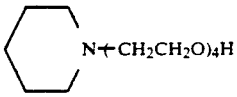
-continued
X-21
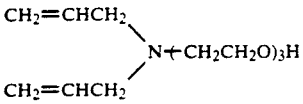
X-22
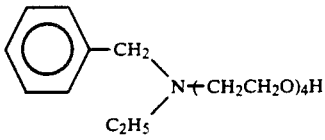
Specific examples of the compounds represented by general formula (X') are illustrated below. However, this invention should not be construed as being limited to these examples.
X'-1
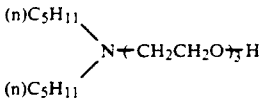
X'-2
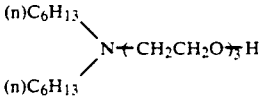
X'-3
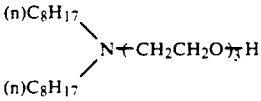
X'-4
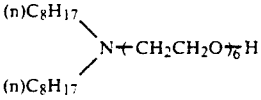
X'-5
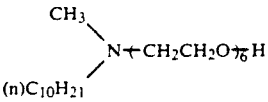
X'-6
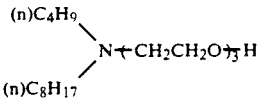
X'-7
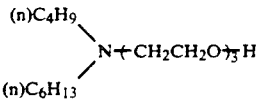
X'-8
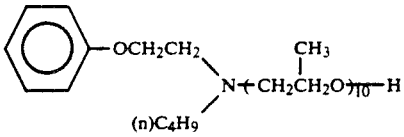
X'-9
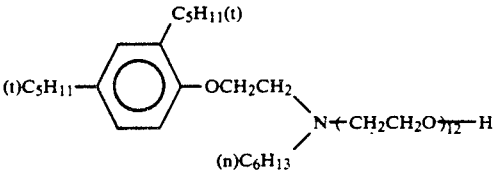

-continued

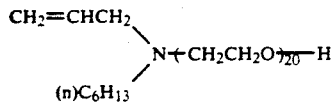

X'-10

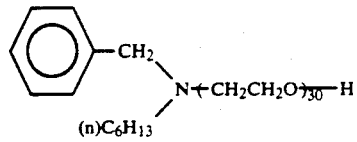

X'-11

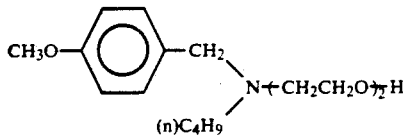

X'-12

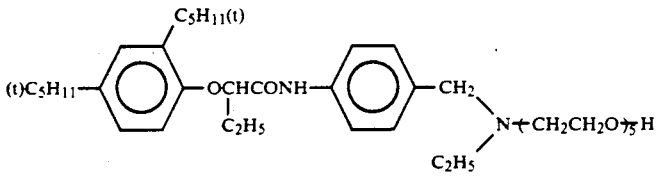

X'-13

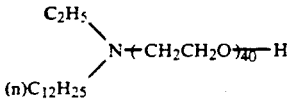

X'-14

The compounds represented by general formulae (X) and (X') of this invention can be prepared with ease by allowing amine compounds to undergo an addition reaction with various ethylene oxide compounds, or a replacement reaction with polyalkylene glycol monohalohydrines, as disclosed, for example, in J. Am. Chem. Soc., 78, 4039 (1956); J. Am. Chem. Soc., 71, 3423 (1949); and Tech. Rept. Osaka Univ., 6, 387 (1956).

The amino compounds represented by formula (X) are dissolved in a developer for use. They are preferably used in an amount of from 0.005 mol to 0.30 mol, particularly from 0.01 mol to 0.2 mol, per liter of a developer.

The amino compounds represented by formula (X) have relatively low solubilities in developers (or water). As a result, these amino compounds sometimes separate out or precipitate when concentrating a developer to decrease its volume.

However, when these compounds are used together with compounds represented by general formula (Y) or (Z), the undesirable separation or precipitation of these amino compounds due to concentration changes is prevented.

$$R_7—SO_3M \quad (Y)$$

$$R_8—COOM \quad (Z)$$

In the above formulae, M represents a hydrogen atom, Na, K, or $NH_4$; and $R_7$ and $R_8$ each represents an alkyl group containing not less than 3 carbon atoms, an alkylbenzene residue, or a benzene residue.

Specific examples of compounds of general formula (Y) include sodium p-toluenesulfonate, sodium benzenesulfonate, and sodium 1-hexanesulfonate. Specific examples of compounds of general formula (Z) include sodium benzoate, sodium p-toluylate, potassium isobutyrate, sodium n-caproate, sodium n-caplylate, and sodium n-caprate.

The compounds represented by general formula (Y) or (Z) are used in an amount depending on the amount of the amino compound present. In general, a suitable concentration of these compounds is 0.005 mol/l or higher; preferably from 0.03 to 0.1 mol/l. A proper ratio of these compounds to the amount of amino compound present ranges from 0.5:1 to 20:1 by mol.

When the amino compounds represented by the general formula (X') are incorporated in a silver halide photographic material, it is desirable that they should have a coverage of from $1\times10^{-7}$ to $1\times10^{-3}$ mol/m$^2$; preferably from $1\times10^{6}$ to $1\times10^{-4}$ mol/m$^2$.

When incorporating these amino compounds into a photographic light-sensitive material, the incorporated layer is preferably a silver halide emulsion layer, but may also be another constituent layer, or a light-insensitive hydrophilic colloid layer (including a protective layer, an interlayer, a filter layer, or an antihalation layer). More specifically, when these amino compounds are soluble in water, they are used in the form of an aqueous solution. On the other hand, when they are only slightly soluble in water, they are added to a hydrophilic colloid solution in such a condition that they can be dissolved in a water-miscible organic solvent such as an alcohol, ester, or ketone.

A compound of general formula (X) and one of general formula (X') may also be used simultaneously in a photographic material.

In a silver halide photographic material to be processed with developer containing a compound of general formula (X), a compound of general formula (X') may or may not be incorporated.

Also, a compound of general formula (X) may or may not be added to a developer to be used for processing the silver halide photographic material containing the compound of the general formula (X').

The developers, other processing solutions, and silver halide photographic materials which can be used in this invention are described below.

Developer of the invention can contain additives (e.g., a developing agent, an alkali agent, a pH buffering agent, a preservative, or a chelating agent).

In the photographic processing of this invention, any known method and any known processing solution can be employed. A processing temperature is generally chosen between 18° C. and 50° C. Of course, it may be set to a temperature lower than 18° C. or higher than 50° C. Either development-processing to form a silver image (black-and-white development-processing) or color photographic processing (development-processing to form color images) may be adopted, if desired.

In black-and-white developer, known developing agents such as dihydroxybenzenes, 1-phenyl-3-pyrazolidones, and aminophenols can be used independently or in combination.

Specific examples of dihydroxybenzene type developing agents include hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone. Of these hydroquinones, hydroquinone is preferred.

Specific examples of 1-phenyl-3-pyrazolidone and its derivatives which are used as an auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Specific examples of auxiliary development agents of the p-aminophenol type include N-methyl-p-aminophenyl, p-aminophenol, N-(8-hydroxyethyl)-p-aminophenol, N-(4-hydroxyphenyl)glycine, 2-methyl-p-aminophenol, and p-benzylaminophenol. Of these p-aminophenols, N-methyl-p-aminophenol is preferred.

A dihydroxybenzene developing agent is generally used in an amount of from 0.05 mol/l to 0.8 mol/l. On the other hand, when dihydroxybenzenes are used in combination with 1-phenyl-3-pyrazolidones or p-aminophenols, it is desirable that from 0.05 mol/l to 0.5 mol/l of dihydroxybenzene, and 0.06 mol/l or less of 1-phenyl-3-pyrazolidone or p-aminophenol be used.

A color developer comprises generally an alkaline aqueous solution containing a color developing agent. As examples of a color developing agent which can be used are the known aromatic primary amine developers. More specifically, phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, or 4-amino-3-methyl-N-ethyl-N-β-methoxyethylaniline) can be used.

Development accelerator can be added to the color developer, if desired. However, it is desirable in order to avoid environmental pollution to facilitate preparation of solution and to prevent fogging that the color developer used in this invention not contain a substantial amount of benzyl alcohol. The expression "a substantial amount of benzyl alcohol" as used herein is intended to include cases where benzyl alcohol is contained in a concentration of 2 ml/l or less. It is particularly preferred that the developer contains no benzyl alcohol.

Sulfite preservatives which can be used in this invention are, for example, sodium sulfite, potassium sulfite, lithium sulfite, sodium hydrogensulfite, potassium metabisulfite, and formaldehyde sodium bisulfite.

In black-and-white developer, especially a graphic arts developer, sulfite is used in a concentration of 0.3 mol/l or more. However, it is desired that the upper limit of sulfite present should be 1.2 mol/l, because too much sulfite generates precipitates in the developer resulting in pollution of developer.

To color developer, a sulfite preservative is added in an amount of from 0 to 0.2 mol/l, preferably from 0 to 0.04 mol/l. It is desirable to add the least possible amount of sulfite as far as the capability of the color developer is kept stable. More specifically, it is preferred that color developer be substantially free of sulfite ion, that is, contain 0.004 mol/l or less, more preferably 0.002 mol/l, based on sodium sulfite.

Alkali agents which can be used in the developer of this invention include pH modifiers and buffers, such as sodium hydroxide, potassium hydroxide, sodium carbonate, potassium carbonate,. sodium tertiary phosphate, potassium tertiary phosphate, sodium silicate, and potassium silicate.

Specific examples of additives, other than the above-cited ones, which may be used include development inhibitors (such as boric acid, borax, sodium bromide, potassium bromide and potassium iodide); organic solvents (such as ethylene glycol, diethylene glycol, triethylene glycol, dimethylformamide, methyl cellosolve, hexylene glycol, ethanol, and methanol); and fog inhibitors or black pepper inhibitors (such as mercapto compounds, including 1-phenyl-5-mercaptotetrazole and sodium 2-mercaptobenzimidazole-5-sulfonate; indazole compounds, including 5-nitroindazole; and benzotriazole compounds, including 5-methylbenzotriazole). In addition, toning agents, surface active agents, defoaming agents, water softeners, hardeners and additional additives so on may be used if needed.

The developer to be used in this invention can contain as a silver stain inhibitor the compounds disclosed in JP-A-56-24347, as an uneven development inhibitor the compounds disclosed in JP-A-62-212651, and as a dissolution aid the compounds disclosed in Japanese Patent Application No. 60-109743 (corresponding to JP-A-61-267759). The developer to be used can also contain as buffers boric acid, as disclosed in Japanese Patent Application No. 61-28708 (corresponding to JP-A-62-186259); sugars (e.g., saccharose), as disclosed in JP-A-60-93433; oximes (e.g., acetoxime); phenols (e.g., 5-sulfosalicylic acid); and tertiary phosphates (e.g., sodium salt, potassium salt); for example.

In color photographic processing, photographic light-sensitive materials are generally subjected to bleach-processing after color development. This bleach-processing may be carried out simultaneously or separately with fixation-processing. As a bleaching agent, compounds of polyvalent metals (such as Fe(III), Co(III), Cr(IV), and Cu(II)), peroxy acids, quinones, and nitroso compounds can be employed. More specifically, ferricyanides, bicromates, organic complex salts of Fe(III) or Cu(III) and organic acids (e.g., aminopolycarboxylic acids such as ethylenediaminetetraacetic acid, nitrotriacetic acid, 1,3-diamino-2-propanoltetraacetic acid, citric acid, tartaric acid, and malic acid); persulfates; permanganates; and nitrosophenols can be used. Of these compounds, potassium ferricyanide, sodium ethylenediaminetetraacetatoferrate(III) and ammonium ethylenediaminetetraacetatoferrate(III) are used to particular advantage. Ethylenediaminetetraacetatoferrate(III) complex salts are useful in both independent bleaching bath and combined bleaching and fixing baths.

Bleach accelerators can be added to the bleaching or bleach-fix bath, such as those disclosed in U.S. Pat. Nos. 3,042,520 and 3,241,966; JP-B-45-8506; and JP-B-45-8836 (the term "JP-B" as used herein means an "examined Japanese patent publication"), and the thiol compounds disclosed in JP-A-53-65732 can be also added to the bath.

A fixer is an aqueous solution containing a fixing agent, and optionally a hardener (e.g., a water-soluble aluminum compound), acetic acid, and a dibasic acid (e.g., tartaric acid, citric acid, salts thereof), and preferably adjusted to pH 3.8 or higher, more preferably 4.0 to 7.5. Tartaric acid and its derivatives, and citric acid and its derivatives can be used alone or in a mixture of two or more. These compounds are effective when contained in an amount of 0.005 mol or more, preferably from 0.01 to 0.03 mol, per liter of fixer.

Specific examples of tartaric acid derivatives are potassium tartarate, sodium tartarate, sodium potassium tartarate, ammonium tartarate, and potassium ammonium tartarate. Specific examples of citric acid derivatives effective in this invention are sodium citrate and potassium citrate.

Sodium thiosulfate and ammonium thiosulfate are examples of fixing agents. Ammonium thiosulfate is particularly preferred in respect of fixing speed. The amount of fixing agent to be used can be changed as desired. In general, it ranges from about 0.1 to about 5 mol/l.

Water-soluble aluminum salts that function mainly as hardeners in a fixer are compounds (generally hardeners of acidic hardening fixers) such as aluminum chloride, aluminum sulfate, and potassium alum.

In addition, the fixer can optionally contain preservatives (e.g., sulfites, bisulfites), pH buffers (e.g., acetic acid, boric acid), pH modifiers (e.g., ammonia, sulfuric acid), image keeping property improvers (e.g., potassium iodide), and chelating agents. pH buffers are used in an amount of from 10 to 40 g/l, preferably from 18 to 25 g/l, because the pH of the developer used is high.

Temperatures and times suitable for fixation, in analogy with those for development, are within the range of 10 seconds to 1 minute at about 20° to 50° C.

In washing water, antifungal agents (including compounds as described, e.g., in H. Moriguchi, *Bokin Bobai no Kagaku* (which means "Antibacterial and Antifungal Chemistry"), and Japanese Patent Application No. 60-253807 (corresponding to JP-A-62-115154)), washing accelerators (e.g., sulfite), and chelating agents may be added.

Washing water may be replenished in an amount of 1,200 ml/m$^2$ or less (including zero).

Herein, the expression "the amount of water replenished is zero" signifies washing with so-called "reserved water." As for the method of effecting a reduction in replenishing washing water, a multistage counter-current method (using two, three or more tank) is known.

Problems produced by reduction in the replenishing of wash water can be solved by using the following means in combination, resulting in accomplishment of satisfactory washability.

In the washing bath or the stabilizing bath, the isothiazoline compounds described in R. T. Kreiman, *J. Imaging Tech.*, Vol. 10, No. 6, p. 242 (1984); the isothiazoline compounds described in *Research Disclosure*, Vol. 205, No. 20526 (May, 1981); the isothiazoline compounds described in Supra, Vol. 228, No. 22845 (Apr., 1983); and the compounds disclosed in JP-A-61-115154 and JP-A-62-209532 can be used together as microbiocides. In addition, compounds as described in Hiroshi Horiguchi, *Bokin Bobai no Kagaku*, Sankyo Shuppan, Tokyo (1982); Nippon Bokin Bobai Gakkai, *Bokin Bobai Gijutsu Handbook* (which means "Handbook on Antibacterial and Antifungal Techniques"), Hakuhodo (1986); "Water Quality Criteria" by L. E. West, published in *Photo. Sci. & Eng.*, Vol. 9, No. 6 (1965); "Microbiological Growths in Motion Picture Processing" by M. W. Beach, published in *SMPTE Journal*, Vol. 85 (1976); and "Photo Processing Wash Water Biocides" by R. O. Deegan, published in *J. Imaging Tech.*, Vol. 10 No. 6 (1984) may be added.

When a reduced amount of washing water is used in this invention, it is more desirable that the processing apparatus should be fitted with squeeze rollers, and crossover rack type washing tanks as described in JP-A-63-18350, JP-A-62-287252 and so on.

Further, as disclosed in JP-A-60-235133 and JP-A-63-129343, a part or all of the solution overflowing the washing or stabilizing bath due to replenishment with water, in which a moldproofing means is introduced, depending on the processing condition can be used for a processing solution having fixing capability which is to be used prior to the washing or stabilization step. Furthermore, water-soluble surfactants and defoaming agents may be added in order to prevent the generation of bubble mark, which tends to be caused by washing with a reduced amount of water, and/or the transfer of some ingredients adhering to the squeeze rollers onto the processed films.

The washing tank may be provided with a dye adsorbent as disclosed in JP-A-63-163456 in order to prevent contamination of the tank with dyes eluted from photographic materials.

In accordance with the description above, photographic materials that have been developed and fixed are washed with water, and then dried. The washing with water is carried out in order to almost completely remove the silver salts dissolved by fixation. A suitable washing time is within the range of 10 sec. to 3 min. at a temperature of from about 20° C. to about 50° C. Drying is carried out at a temperature ranging from about 40° C. to about 100° C. Drying time can be varied depending on the surrounding condition and may generally range from about 5 sec. to about 3.5 min.

Automatic processing machines of roller conveyance type described, e.g., in U.S. Pat. Nos. 3,025,779 and 3,545,971, are referred to as "roller auto processors." The roller auto processors comprises development, fixation, washing and drying steps. It is most desirable in the method of this invention to follow these four steps, though other steps (e.g., a stop step) can be included. Herein, water savings can be achieved by applying a two- or three-stage counter-current method in the washing step.

The developer used in this invention is preferably preserved in the form of a package wrapped with a material that is highly resistant to oxygen permeation, as disclosed in JP-A-61-73147. In addition, the replenishing system disclosed in JP-A-62-91939 can be applied advantageously to the developer used in this invention.

When undergo reduction processing after image formation, graphic arts silver halide photographic materials of this invention maintain high density, notwithstanding the reduction of halftone dot area, because of their high $D_{max}$.

Reducers of any kind can be used in this invention. For instance, those described in C. E. K. Mees, *The Theory of the Photographic Process*, pp. 738 to 744, Macmillan (1954); Tetsuo Yano, *Shashin Shori, sono Riron to Oyo* (which means "Photographic Processing, Its Application and Practice"), pp. 166 to 169, Kyoritsu Shuppan (1978); JP-A-50-27543; JP-A-52-68429; JP-A-55-17123; JP-A-55-79444; JP-A-57-142639; and JP-A-61-61155 can be used. More specifically, reducers which use as an oxidizing agent permanganates, persulfates, ferric salts, cupric salts, ceric salts, hexacyanoferrate(III), and dichromates either independently or in combination, and optionally contain an inorganic acid like sulfuric acid and an alcohol; and reducers which comprise an oxidizing agent such as a hexacyanoferrate(III) or an ethylenediaminetetraacetatoferrate(III), a silver halide solvent such as a thiosulfate, a rhodanine, a thiourea and their derivatives, and optionally an inorganic acid such as sulfuric acid can be employed.

Typical examples of reducers which can be employed are, for example, Farmer's reducer, ethylenediaminetetraacetatoferrate(III) reducer, potassium permanganate reducer, ammonium persulfate reducer (Kodak R-5), and ceric salt reducer.

It is desired that the reduction processing should be completed in several seconds to scores of minutes, preferably in several minutes or less, at a temperature of 10° C. to 40° C., preferably 15° C. to 30° C. A sufficiently wide reduction range can be obtained within the limits of these conditions when the graphic arts photographic material of this invention is used. The reducer is made to act on the silver image formed in an emulsion layer via light-insensitive upper layer(s) containing the compound of this invention.

There are various ways to make the reducer act. For instance, graphic arts photographic materials are soaked in a reducer with stirring, or a reducer is applied to the surfaces of graphic arts photographic materials by means of a brush or a roller.

Hydrazine derivatives which can be used in this invention are preferably represented by the following general formula (I):

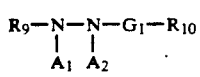

(I)

(wherein $R_9$ represents an aliphatic group, or an aromatic group; $R_{10}$ represents a hydrogen atom, an alkyl group, an aryl group, an alkoxy group, an aryloxy group, an amino group, a hydrazino group, a carbamoyl group, or an oxycarbonyl group; $G_1$ represents a carbonyl group, a sulfonyl group, a sulfoxy group,

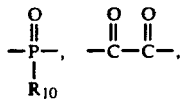

a thiocarbonyl group, or an iminomethylene group; and both $A_1$ and $A_2$ represent a hydrogen atom, or one of them is a hydrogen atom and the other represents a substituted or unsubstituted alkylsulfonyl group, a substituted or unsubstituted arylsulfonyl group, or a substituted or unsubstituted acyl group).

In the foregoing general formula (I), an aliphatic group represented by $R_9$ preferably contains from 1 to 30 carbon atoms; especially preferred groups include straight-chain, branched and cyclic alkyl groups containing 1 to 20 carbon atoms. Herein, the branched alkyl groups may be cyclized to form a saturated hetero ring containing one or more hetero atoms. Further, these alkyl groups may be substituted by an aryl group, an alkoxy group, a sulfoxy group, a sulfonamido group, or a carbonamido group.

The aromatic group represented by $R_9$ includes mono- and di-cyclic aryl groups, and unsaturated heterocyclyl groups. These unsaturated heterocyclyl groups may include heteroaryl groups formed by condensation with a mono- or di-cyclic aryl group.

Specific examples of such aromatic groups include a phenyl group, naphthyl group, a pyridyl group, a pyrimidyl group, an imidazolyl group, an pyrazolyl group, a quinolyl group, an isoquinolyl group, a benzimidazolyl group, a thiazolyl group, and a benzothiazolyl group. Among these, those containing a benzene ring (a phenyl group) are preferred.

Groups particularly preferred as $R_9$ are aryl groups.

Aryl groups and unsaturated heterocyclyl groups represented by $R_9$ may have a substituent group. Typical such substituent groups include alkyl groups, aralkyl groups, alkenyl groups, alkinyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl group, halogen atoms, cyano group, sulfo group, alkyloxycarbonyl groups, aryloxycarbonyl groups, acyl groups, alkoxycarbonyl groups, acyloxy groups, carbonamido groups, sulfonamido groups, carboxyl group, phosphoric acid amido groups, diacylamino groups, imido groups, and

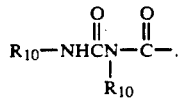

Among these, straight-chain, branched or cyclic alkyl groups (especially those containing 1 to 20 carbon atoms), aralkyl groups (especially mono- or di-cyclic ones which have an alkyl moiety containing 1 to 3 carbon atoms), alkoxy groups (especially those containing 1 to 20 carbon atoms), substituted amino groups (especially those substituted by alkyl group(s) containing 1 to 20 carbon atoms), acylamino groups (especially those containing 2 to 30 carbon atoms), sulfonamido groups (especially those containing 1 to 30 carbon atoms), ureido groups (especially those containing 1 to 30 carbon atoms), and phosphoric acid amido groups (especially those containing 1 to 30 carbon atoms) are particularly preferred as the substituent(s).

As for the alkyl group represented by $R_{10}$ in the general formula (I), those containing 1 to 4 carbon atoms are preferred. These may be substituted by a halogen atom, cyano group, carboxyl group, sulfo group, an alkoxy group, a phenyl group, an acyl group, an alkoxycarbonyl group, an aryloxycarbonyl group, a carbamoyl group, an alkylsulfo group, an arylsulfo group, a sulfamoyl group, a nitro group, an aromatic heterocyclic group, or

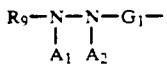

(where $R_9$, $A_1$, $A_2$, and $G_1$ are the same as described above for general formula (I)). These substituents may further be substituted by some group.

As for the aryl group, mono- and di-cyclic aryl groups, e.g., those containing a benzene ring are preferred. Such groups may be substituted by the groups described as the substituents for alkyl groups, above.

Preferred alkoxy groups are those containing 1 to 8 carbon atoms. These may be substituted, for example, by a halogen atom or an aryl group.

Preferred aryloxy groups are monocyclic aryloxy groups. These may be substituted, for example, by a halogen atom.

Preferred amino groups are unsubstituted ones and those substituted by an alkyl group containing from 1 to 10 carbon atoms or an aryl group. These substituted amino groups may further be substituted by an alkyl group, a halogen atom, a cyano group, a nitro group, or a carboxyl group.

Preferred carbamoyl groups are unsubstituted ones and those substituted by an alkyl group containing from 1 to 10 carbon atoms or an aryl group. These substituted ones may further be substituted, for example, by an alkyl group, a halogen atom, a cyano group, or a carboxyl group.

Preferred oxycarbonyl are alkoxycarbonyl groups containing from 1 to 10 carbon atoms and aryloxycarbonyl groups. These may further be substituted, for example, by an alkyl group, a halogen atom, a cyano group, or a nitro group.

When $G_1$ represents a carbonyl group, preferred $R_2$ groups include a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), and an aryl group (e.g., phenyl, 3,5-dichlorophenyl, o-methanesulfonamidophenyl, and 4-methanesulfonylphenyl). In particular, a hydrogen atom is favored.

When $G_1$ represents a sulfonyl group, preferred $R_{10}$ groups include an alkyl group (e.g., methyl), an aralkyl group (e.g., o-hydroxyphenylmethyl), an aryl group (e.g., phenyl), and a substituted amino group (e.g., dimethylamino).

When $G_1$ represents a sulfoxy group, preferred $R_{10}$ groups include a cyanobenzyl group and a methylthiobenzyl group.

When $G_1$ represents

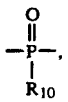

preferred $R_2$ groups include a methoxy group, an ethoxy group, a butoxy group, a phenoxy group, and a phenyl group. In particular, a phenoxy group is favored.

When $G_1$ represents an N-substituted or unsubstituted iminomethylene group, preferred $R_2$ groups include a methyl group, an ethyl group, and a substituted or unsubstituted phenyl group.

Substituent groups for $R_{10}$ are those set forth above for $R_9$.

Most preferred as $G_1$ is a carbonyl group.

In addition, $R_{10}$ may be a group that will split off the moiety $-G_1-R_{10}$ from the residual molecule and undergo a cyclization reaction resulting in the formation of a cyclic structure containing atoms in the moiety $-G_1-R_{10}$. This moiety can be represented concretely by the general formula (a):

$$-R_{11}-Z_1 \qquad \text{(a)}$$

(wherein $Z_1$ is a group that will make a nucleophilic attack against $G_1$ to split off the moiety $-G_1-R_{11}-Z_1$ from the residual molecule; and $R_{11}$ is the remainder of $R_{10}$ obtained by eliminating a hydrogen atom from $R_{10}$ that enables the formation of a cyclic structure using $G_1$, $R_{11}$ and $Z_1$ upon the nucleophilic attack of $Z_1$ upon $G_1$).

More specifically, $Z_1$ is a group capable of easily undergoing a nucleophilic reaction with the group $G_1$ when the hydrazine compound of the general formula (I) produces the reaction intermediate, $R_9-N=N-G_1-R_{11}-Z_1$, by oxidation, thereby splitting off the group represented by $R_9-N=N-$ from $G_1$.

Examples of $Z_1$ include functional groups capable of reacting directly with $G_1$, such as $-OH$, $-SH$, $-NHR_{12}$ (wherein $R_{12}$ represents a hydrogen atom, an alkyl group, an aryl group, $-COR_{13}$, or $-SO_2R_{13}$; and $R_{13}$ represents a hydrogen atom, an alkyl group, an aryl group, or a heterocyclyl group), or $-COOH$ (the $-OH$, $-SH$, $-NHR_{12}$ and $-COOH$ group may be temporarily protected so that they will be converted to their original form through hydrolysis with an alkali) and functional groups capable of reacting with $G_1$ through the reaction with a nucleophilic reagent (e.g., hydroxide ion, sulfite ion), such as

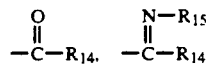

(wherein $R_{14}$ and $R_{15}$ each represents a hydrogen atom, an alkyl group, an alkenyl group, an aryl group, or a heterocyclyl group), and so on.

A ring formed by groups $G_1$, $R_{11}$, and $Z_1$ is preferably a 5- or 6-membered one.

Among the moieties represented by the general formula (a), those represented by the following general formulae (b) and (c) respectively are favored.

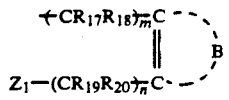

(b)

In the foregoing formula, the substituents from $R_{17}$ to $R_{20}$ may be the same or different, each being a hydrogen atom, an alkyl group (preferably containing from 1 to 12 carbon atoms), an alkenyl group (preferably containing from 2 to 12 carbon atoms), or an aryl group (preferably containing from 6 to 12 carbon atoms). B represents atoms necessary to complete an optionally substituted 5- or 6-membered ring. m and n each represents 0 or 1, provided that n+m is 1 or 2.

Specific examples .of a 5- or 6-membered ring completed by B include a cyclohexene ring, a cycloheptane ring, a benzene ring, a naphthalene ring, a pyridine ring, and a quinoline ring.

$Z_1$ in general formula (b) has the same meaning as in the general formula (a).

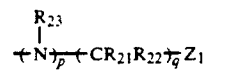

(c)

In formula (c) above, $R_{21}$ and $R_{22}$ may be the same or different, each being a hydrogen atom, an alkyl group, an alkenyl group, an aryl group, or a halogen atom.

$R_{23}$ represents a hydrogen atom, an alkyl group, an alkenyl group, or an aryl group.

p represents 0 or 1, and q represents an integer from 1 to 4.

$R_{21}$, $R_{22}$ and $R_{23}$ may form a ring by combining with one another, provided that the resulting ring does not prevent the intramolecular nucleophilic attack of $Z_1$ upon $G_1$.

It is desirable in the general formula (c) that $R_{21}$ and $R_{22}$ each should be a hydrogen atom, a halogen atom, or an alkyl group, while $R_{23}$ should be an alkyl group or an aryl group.

q is preferably an integer from 1 to 3. When q is 1, p represents 0 or 1; when q is 2, p represents 0 or 1; and when q is 3, p represents 0 or 1. When q is 2 or 3, $R_{21}$'s and $R_{22}$'s may be the same as or different from one another.

$Z_1$ in the general formula (c) has the same meaning as in the general formula (a).

In the foregoing general formula (I), $A_1$ and $A_2$ each represents a hydrogen atom, an alkylsulfonyl group containing not more than 20 carbon atoms, an arylsulfonyl group (preferably including phenylsulfonyl group, and a phenylsulfonyl group substituted so that the Hammett's $\sigma$ values of its substituents total $-0.5$ or more), or an acyl group containing not more than 20 carbon atoms (preferably including a benzyl group or a benzyl group substituted so that the Hammett's $\sigma$ values of its substituents total $-0.5$ or more), and a straightchain, branched or cyclic, unsubstituted or substituted aliphatic acyl group (whose substituent(s) may be a halogen atom, an ether group, a sulfonamido group, a carbonamido group, a hydroxyl group, a carboxyl group or/and a sulfo group)).

The most preferred substituent group for $A_1$ and $A_2$ is hydrogen.

$R_9$ or $R_{10}$ in general formula (I) may be a group into which ballast groups or polymer moieties commonly used in nondiffusible photographic additives, such as a coupler, is introduced. The ballast group is a group containing at least 8 carbon atoms that is comparatively inert in terms of photographic properties, such as an alkyl group, an alkoxy group, a phenyl group, an alkylphenyl group, a phenoxy group, or an alkylphenoxy group. Polymer moieties are disclosed, for example, in JP-A-01-00530.

$R_9$ or $R_{10}$ in general formula (I) may be a group into which a moiety capable of promoting the adsorption of the compound of general formula (I) to the surfaces of silver halide grains is introduced. Specific examples of such an adsorptive group are thiourea groups, heterocyclic thioamido groups, mercaptoheterocyclyl groups, and triazole groups. These are disclosed in U.S. Pat. Nos. 4,385,108 and 4,459,347; JP-A-59-195233; JP-A-59-200231; JP-A-59-201045; JP-A-59-201046; JP-A-59-201047; JP-A-59-201048; JP-A-59-201049; JP-A-61-170733; JP-A-61-270744; JP-A-62-948; and Japanese Patent Application Nos. 62-67508 and 62-67510 (corresponding to JP-A-63-234244 and JP-A-63-234246, respectively).

Specific examples of the compound represented by the general formula (I) are illustrated below. However, the invention should not be construed as being limited to these examples.

I-1

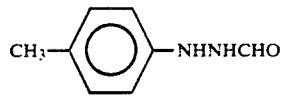

I-2

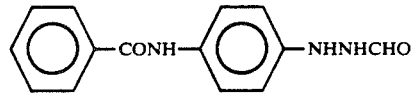

I-3

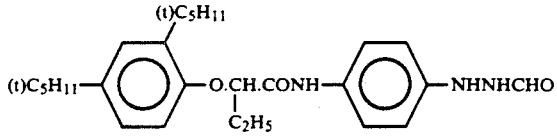

I-4

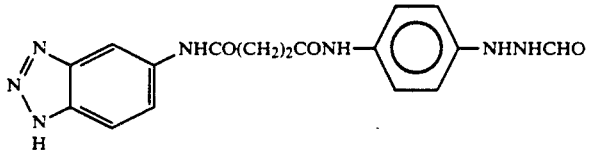

-continued
I-5
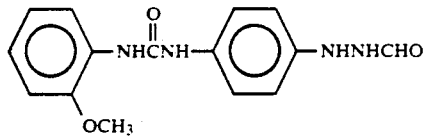
I-6
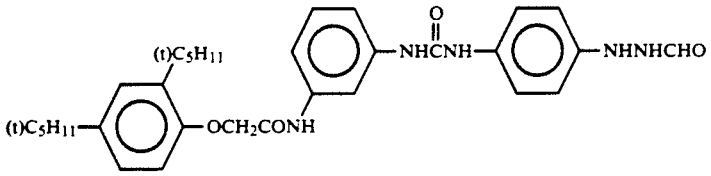
I-7
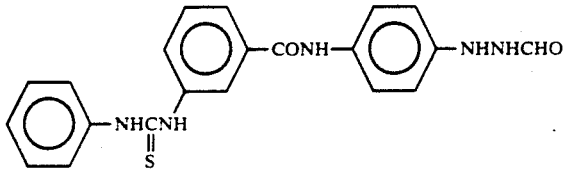
I-8
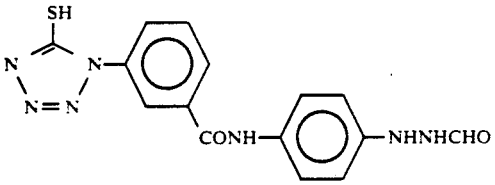
I-9
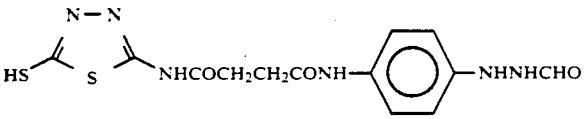
I-10
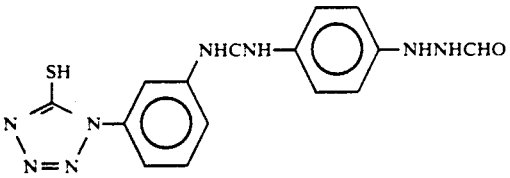
I-11
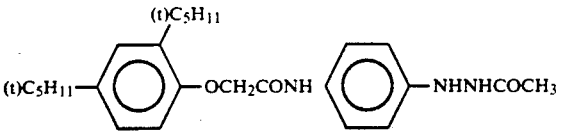
I-12
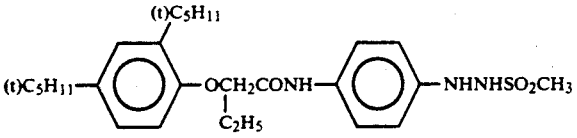
I-13
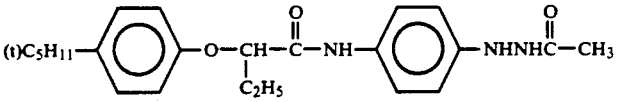
I-14
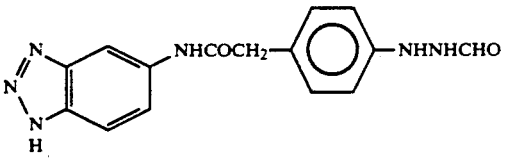

-continued

I-15

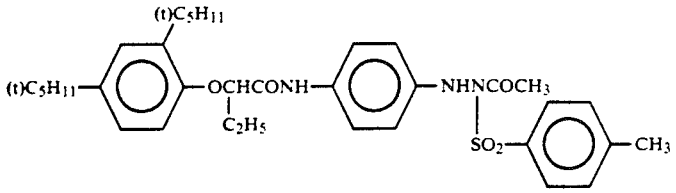

I016

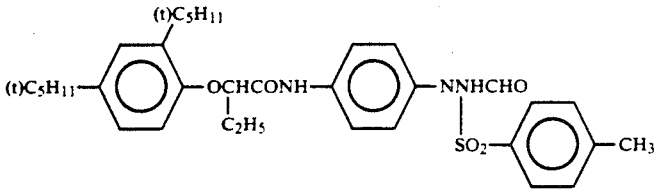

I-17

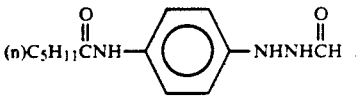

I-18

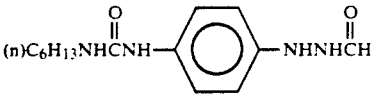

I-19

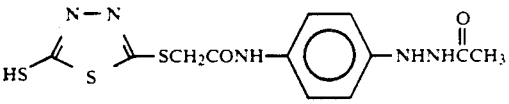

I-20

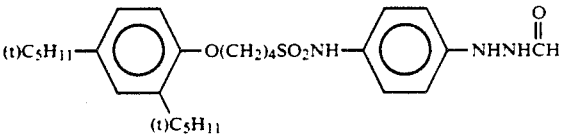

I-21

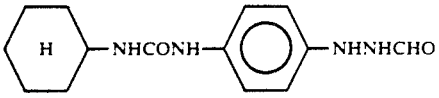

I-22

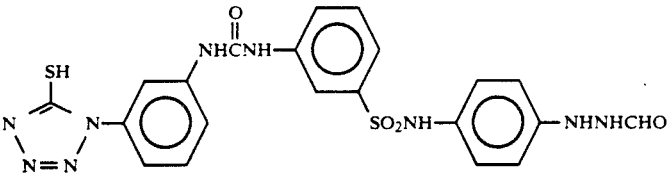

I-23

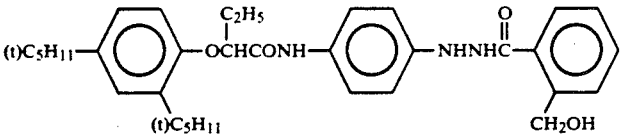

In addition to the above compounds, additional hydrazine derivatives useful in this invention are described in *Research Disclosure*, Item 23516, page 346 (Nov., 1983) and those described in the quoted references; and those disclosed in U.S. Pat. Nos. 4,080,207, 4,269,929, 4,276,364, 4,278,748, 4,385,108, 4,459,347, 4,560,638 and 4,478,928; British Patent 2,011,391B; JP-A-60-179734; JP-A-62-270948; JP-A-63-29751; JP-A-61-170733; JP-A-61-270744; JP-A-62-948; EP 217,310 or U.S. Pat. No. 4,686,167; JP-A-62-178246; JP-A-63-32538; JP-A-63-104047; JP-A-63-121838; JP-A-63-129337; JP-A-63-223744; JP-A-63-234244; JP-A-63-234245; JP-A-63-234246; JP-A-63-294552; JP-A-63-306438; JP-A-01-100530; JP-A-01-105941; JP-A-01-05943; JP-A-64-10233; and JP-A-01-90439.

In incorporating the hydrazine derivatives cited above into a photographic light-sensitive material, it is preferred that the hydrazine derivative be incorporated into the silver halide emulsion layer. Of course, it may be incorporated in other light-insensitive hydrophilic colloid layers (e.g., a protective layer, an interlayer, a filter layer, or an antihalation layer).

More specifically, the hydrazine derivative to be used is added to a hydrophilic colloid solution as an aqueous solution when it is soluble in water, or in a condition to be dissolved in a water-miscible organic solvent, such as alcohols, esters, ketones or the like, when it is only slightly soluble in water.

When the hydrazine derivative is added to a silver halide emulsion layer, it can be added to the emulsion at any stage of preparation, from the beginning of chemical ripening to before the coating. Preferably, it is added between the conclusion of chemical ripening and just before the coasting; most preferably when the coating composition is ready for coating.

It is desirable that the amount of hydrazine derivative to be added should be chosen as an optimum depending upon the grain size and the halogen composition of the silver halide emulsion, the method and the extent of chemical sensitization, the relationship between the layer in which the derivative is to be incorporated and the silver halide emulsion layer, and the kind of antifoggants used, for example. Testing methods for the optimal choice are well known to ones skilled in the art.

In general, the hydrazine derivatives are added in an amount ranging from $10^{-6}$ to $1\times10^{-1}$ mole; preferably from $10^{-5}$ to $4\times10^{-2}$ mole, per mole of silver halide.

On the other hand, the hydrazine derivatives can be used by mixing them with a developer. A suitable amount to be mixed in ranges from 5 mg to 5 g, particularly from 10 mg to 1 g, per liter of developer.

Silver halide photographic materials to which the image forming method of this invention is applied are described in detail, below.

Silver halide emulsions which can be used in this invention are not limited with respect to halide composition. Though the silver halide to be used may be of any composition, including silver chloride, silver chlorobromide, silver iodobromide, silver bromide, and silver iodobromochloride, it is desirable that the iodide content be 10 mol % or less, preferably 3 mol % or less.

Silver halide grains in a photographic emulsion usable in this invention, can have a relatively broad size distribution, but preferably have a narrow size distribution. In particular, it is desired that they have a size distribution such that 90% of the grains have their individual sizes within the range of the number or weight average grain size ±40%. (In general, emulsions having such a size distribution are called "monodisperse emulsions.")

As for the silver halide grains to be used in this invention, fine grains (e.g., 0.7 μm or less in size) are preferred. Particularly preferred are those having a size of 0.4 μm or less.

The silver halide grains in the photographic emulsion may have a regular crystal form, such as that of a cube or an octahedron; an irregular crystal form, such as a sphere or a plate; or a composite form.

The interior and the surface of the silver halide grains may differ, or the silver halide grains may be uniform throughout.

Two or more kinds of silver halide emulsions prepared separately may be used as a mixture.

In a process of producing silver halide grains or allowing the produced silver halide grains to ripen physically, cadmium salts, zinc salts, lead salts, thallium salts, iridium salts or complexes, and rhodium salts or complexes may be present.

The silver halide emulsions to be used in this invention, though can be a primitive emulsion, that is to say, a chemically unsensitized emulsion, are generally chemically sensitized. Chemical sensitization can be carried out using processes described, e.g., in H. Frieser, *Die Grundlagen der Photographischen Prozesse mit Silverhalogeniden*, Akademische Verlagsgesellschaft (1968), and so on.

More specifically, sulfur sensitization using sulfur compounds that are capable of reacting with silver ion or active gelatin (e.g., thiosulfates, thioureas, mercapto compounds, and rhodanines); reduction sensitization using reducing materials (e.g., stannous salts, amines, hydrazine derivatives, formamidine-sulfinic acid, and silane compounds); noble metal sensitization with noble metal compounds (e.g., gold compounds, complex salts of Group VIII metals such as platinum, iridium, and palladium) can be employed individually or as a combination.

As the binder or protective colloid for the emulsion layers and interlayers of the photographic materials of this invention, gelatin is of great advantage. Of course, other hydrophilic colloids can also be employed.

Specific examples of hydrophilic colloids which can be used include proteins (such as gelatin derivatives, graft copolymers prepared from gelatin, and other high molecular weight polymers, albumin and casein); sugar derivatives. (such as sodium alginate, starch derivatives, cellulose derivatives like hydroxyethyl cellulose, carboxymethyl cellulose, and cellulose sulfate); and various kinds of synthetic hydrophilic high molecular weight substances such as homo- or copolymers including polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Gelatin that can be used includes lime-processed gelatin, acid-processed gelatin, and enzyme-processed gelatin, as described, e.g., in *Bell. Soc. Sci. Phot. Japan*, No. 16, p. 30 (1966). In addition, hydrolysis products of gelatin, and enzymatic degradation products of gelatin can also be used.

The photographic emulsions used in this invention may be spectrally sensitized using methine dyes or other dyes. Suitable spectral sensitizing dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are the cyanine dyes, the merocyanine dyes, and the complex merocyanine dyes. These sensitizing dyes may be employed in a combination that will produce a supersensitizing effect.

Dyes that exhibit a supersensitizing effect in a combination with a sensitizing dye although they themselves do not spectrally sensitize silver halide emulsions or substances that exhibit a supersensitizing effect in combination with a sensitizing dye although they themselves do not absorb light in the visible region may be incorporated into the silver halide emulsion. For example, aminostilbene compounds substituted by nitrogen-containing heterocyclic groups (e.g., as disclosed in U.S. Pat. Nos. 2,933,390 and 3,635,721); aromatic organic acid-formaldehyde condensates (e.g., as disclosed in U.S. Pat. No. 3,743,510); cadmium salts; and azaindene compounds can be used. Particularly useful combinations are disclosed in U.S. Pat. Nos. 3,615,613, 3,615,641, 3,617,295 and 3,635,721.

The photographic emulsions used in this invention can contain a wide variety of compounds for the purpose of preventing fog or stabilizing photographic functions during production, storage, or photographic processing. Specifically, azoles (such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole)); mercaptopyrimidines; mercaptotriazines; thioketo compounds (such as oxazolinethione); azaindenes (such as triazaindenes, tetraazaindenes (particularly 4-hydroxy-substituted (1,3,3a,7)-tetraazaindenes), and pentaazaindenes); and compounds known to act as an antifoggant or stabilizer (such as benzenethiosulfonic acid, benzenesulfinic acid, benzenesulfonic acid amide) can be added to the photographic emulsion. Among these compounds, benzotriazoles (e.g., 5-methylbenzotriazole) and nitroindazoles (e.g., 5-nitroindazole) are preferred. Also, these compounds may be contained in a processing solution.

The photographic light-sensitive material of this invention may contain an inorganic or organic hardener in the photographic emulsion layers or other hydrophilic colloid layers. Specific examples of such hardeners include chromium salts (e.g., chrome alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine and 1,3-vinylsulfonyl-2-propanol), active halogen-containing compounds (e.g., 2,4-dichloro-6-hydroxy-s-triazine), and mucohalogenic acids (e.g., mucochloric acid and mucophenoxychloric acid). These hardeners can be used alone, or as a mixture of two or more.

The photographic emulsion layers and other hydrophilic colloid layers of the photographic material of this invention may contain various kinds of surface active agents for a wide variety of purposes, for instance, as a coating aid, to prevent electrification, to improve slippability, for emulsification dispersion, to prevent adhesion, to improve photographic characteristics (e.g., acceleration of development, to increase the contrast, sensitization, etc.), and so on.

Examples of suitable surface active agents include nonionic surface active agents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, and polyethylene oxide adducts of silicone); glycidol derivatives (e.g., alkenylsuccinic acid polyglyceride and alkylphenol polyglyceride); fatty acid esters of polyhydric alcohols; alkyl esters of sugars; anionic surface active agents containing acid groups such as a carboxyl group, a sulfo group, a phospho group, a sulfate group, or a phosphate group (for example, alkyl carboxylates, alkyl sulfonates, alkylbenzene sulfonates, alkylnaphthalene sulfonates, alkyl sulfates, alkyl phosphates, N-acryl-N-alkyltaurines, sulfonic acid esters, sulfoalkylpolyoxyethylene alkyl phenyl ethers, and polyoxyethylene alkylphosphoric acid esters); amphoteric surface active agents (such as amino acids, aminoalkylsulfonic acids, aminoalkylsulfonic or phosphoric acid esters, alkylbetaines, or amine oxides); and cationic surface active agents (such as alkylamine salts, aliphatic or aromatic quaternary ammonium salts, and heterocyclic quaternary ammonium salts such as pyridinium or imidazolium salts, or aliphatic or heterocyclic phosphonium or sulfonium salts).

Particularly preferred surface active agents in this invention are polyalkylene oxide having a molecular weight of 600 or more which is disclosed in JP-B-58-9412.

For the purpose of improvements in dimensional stability and so on, the photographic emulsion layers or other hydrophilic colloid layers can contain a dispersion of a synthetic polymer that is insoluble or slightly soluble in water. Synthetic polymers like this that can be used include those containing as constitutional repeating units an alkyl(meth)acrylate, an alkoxyalkyl(meth)acrylate, glycidyl(meth)acrylate, a (meth)acrylamide, a vinyl ester (e.g., vinyl acetate), acrylonitrile, an olefin, or a styrene either individually or in a combination of two or more; or those that contain a combination of these monomers with acrylic acid, methacrylic acid, an $\alpha,\beta$-unsaturated dicarboxylic acid, a hydroxyalkyl(meth)acrylate, a sulfoalkyl(meth)acrylate, or a styrenesulfonic acid.

Silver halide emulsions used for a photographic material utilizing paper as a support (photographic paper), while not particularly restricted, are preferably monodisperse emulsions.

Silver halides present in the silver halide emulsions of photographic paper may include silver chloride, silver bromide, and mixed silver halides such as silver chlorobromide, silver chloroiodobromide, silver iodobromide, for example.

The crystal structure of the silver halide grains may be uniform throughout, or the grains may have a layered structure in which the interior and the surface of the grains differ, or the grains may be conversion type grains as disclosed in British Patent 635,841 and U.S. Pat. No. 3,622,318. Further, either silver halide grains of the kind which form a latent image predominantly at the surface of the grain, or grains of the kind which mainly form a latent image inside the grains can be used. Also, these two kinds of grains may be used as a mixture. The silver halide emulsions comprising the grains froming internal latent images can function as direct positive emulsions when used in combination with the proper nucleating agent or an optical fogging means.

In the process of producing silver halide grains or allowing the produced grains to ripen physically, a cadmium salt, a zinc salt, a lead salt, a thallium salt, an iridium salt, a rhodium salt, and/or an iron salt, for example, may be present. Among these salts, rhodium salts are particularly preferred. Specific examples of rhodium salts that can be used advantageously include water-soluble rhodium(III)-halogen complex salts (e.g., hexachlororhodium(III) acid, or its salts (ammonium salt, sodium salt, or potassium salt). When such a rhodium salt is used in a relatively large amount, the resulting photographic material can be handled safely under room light that has been filtered to remove ultraviolet radiation. On the other hand, when this rhodium salt is used in a relatively small amount, the contrast of the resulting photographic material can be increased.

The silver halide emulsions of the invention can usually be sensitized chemically using sulfur sensitization, selenium sensitization, reduction sensitization, and/or sensitization with noble metals, for example.

These silver halide emulsions may also be spectrally sensitized using spectral sensitizing dyes.

The silver halide emulsion layers and other constituent layers can contain as development accelerators the compounds disclosed in U.S. Pat. Nos. 3,288,612, 3,333,959, 3,345,175 and 3,708,303; British Patent 1,098,748; and West German Patents 1,141,531 and 1,183,784.

In this invention, the above-described hydrazine derivatives may also be incorporated into the silver halide photographic materials using a paper support (e.g., a paper support coated with a polyolefin) to impart high contrast photographic characteristics to the resulting materials.

Also, high contrast photographic characteristics may be given by the addition of the teterazolium compounds disclosed, e.g., in JP-A-52-18317, JP-A-53-17719, JP-A-53-17720, JP-A-59-228645, JP-A-60-31134, and JP-A-59-231527.

In addition, polyalkylene oxide compounds, such as condensates prepared from polyalkylene oxides consisting of at least 10 units of alkylene oxides containing from 2 to 4 carbon atoms (e.g., ethylene oxide, propylene-1,2-oxide, and butylene-1,2-oxide, preferably ethylene oxide) and compounds containing at least one active hydrogen atom (e.g., water, aliphatic alcohols, aromatic alcohols, fatty acids, organic amines, and hexitol derivatives); and block copolymers of two or more kinds of polyalkylene oxides can be used.

The photographic light-sensitive materials of this invention may contain color image-forming couplers, or compounds capable of forming colors by an oxidative coupling reaction with an aromatic primary amine developing agent (e.g., phenylenediamine derivatives, aminophenol derivatives) during color development-processing.

The couplers incorporated in the present photographic materials are preferably non-diffusible ones containing a hydrophobic, ballast group in the molecule, or polymerized couplers. They may be either four-equivalent or two-equivalent to a silver ion. Further, colored couplers having a color correcting effect, or couplers capable of releasing a development inhibitor upon development (so-called DIR couplers) may also be incorporated. Further, colorless DIR coupling compounds which produce a colorless compound and release a development inhibitor in the coupling reaction may be incorporated into the invention.

Preferable yellow couplers are those disclosed in e.g., U.S. Pat. Nos. 3,933,501, 4,022,620, 4,326,024 and 4,401,752; JP-B-58-10739; and British Patents 1,425,020 and 1,476,760.

Preferable magenta couplers which can be used include compounds of 5-pyrazolone and pyrazoloazole types. In particular, those disclosed, e.g., in U.S. Pat. Nos. 4,310,619 and 4,351,897; European Patent 73,636; U.S. Pat. Nos. 3,061,432 and 3,725,067; *Research Disclosure*, No. 24220 (June, 1984); JP-A-60-33552; *Research Disclosure*, No. 24230 (June, 1984); JP-A-60-43659; and U.S. Pat. Nos. 4,500,630 and 4,540,654.

Cyan couplers which can be used include compounds of phenol and naphthol types, preferably those disclosed, e.g., in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173; West German Patent Application (OPI) No. 3,329,729; EP-A-0121365; and U.S. Pat. Nos. 3,446,622, 4,333,999, 4,451,559 and 4,427,767.

Colored couplers for correcting unnecessary absorption of the developed colors that are preferably used include those disclosed, e.g., in *Research Disclosure*, No. 17643, Item VII-G (Dec., 1978); U.S. Pat. No. 4,163,670; JP-B-57-39413; U.S. Pat. Nos. 4,004,929 and 4,138,258; and British Patent 1,146,368.

Preferable couplers capable of forming dyes with an appropriate diffusibility include those disclosed, e.g., in U.S. Pat. No. 4,366,237; British Patent 2,125,570; European Patent 96,570; and West German Patent Application (OLS) No. 3,234,533.

Typical examples of polymerized dye-forming couplers are described in U.S. Pat. Nos. 3,451,820, 4,080,211 and 4,367,282; and British Patent 2,102,173.

Couplers which can release a photographically useful residue upon coupling can also be used advantageously in this invention. As for the DIR couplers that release a development inhibitor, those disclosed in the patents cited in *Research Disclosure* RD-17643, Item VII-F (Dec., 1978); JP-A-57-154234; JP-A-60-184248; JP-A-61-249052; JP-A-61-238057; JP-A-61-236550; JP-A-61-240240; JP-A-61-231553; JP-A 61-233741; and U.S. Pat. Nos. 4,248,962, 4,477,563, and 4,146,396 are favored.

Couplers that imagewise release a nucleating agent or a development accelerator preferred are those disclosed in British Patents 2,097,140 and 2,131,188; JP-A-59-157638; and JP-A-59-170840.

Examples of other couplers that can be used in the photographic materials of this invention are the competing couplers disclosed, e.g., in U.S. Pat. No. 4,130,427; the poly-equivalent couplers disclosed, e.g., in U.S. Pat. Nos. 4,283,472, 4,338,393, and 4,310,618; DIR redox compound-releasing compounds disclosed, e.g., in JP-A-60-185950, couplers to release a dye capable of recoloring after elimination which are disclosed in EP-A-0173302.

Also, compounds that release a development inhibitor upon development other than DIR couplers, may be incorporated in the photographic materials. Suitable examples of such compounds are disclosed, e.g., in U.S. Pat. Nos. 3,379,529 and 3,620,746; JP-A-60-233648; JP-A-61-18946; and JP-A-61-230135.

In order to realize particular required characteristics of the photographic materials, two or more kinds of couplers chosen from those described above can be incorporated together in the same layer, or one coupler can be added to two or more different layers.

Introduction of couplers into silver halide emulsion layers can be performed using known methods, e.g., the method disclosed in U.S. Pat. No. 2,322,027. For instance, the couplers are first dissolved in a high boiling organic solvent, such as an alkyl phthalates (e.g., dibutyl phthalate or dioctyl phthalate), a phosphoric acid ester (e.g., diphenyl phosphate, triphenyl phosphate, tricresyl phosphate, or dioctyl butyl phosphate), a citric acid ester (e.g., tributyl acetylcitrate), a benzoic acid ester (e.g., octyl benzoate), an alkylamide (e.g., diethyllaurylamide), a fatty acid ester (e.g., dibutoxyethylsuccinate, diethylazerate), a trimesic acid ester (e.g., tributyl trimesate); or an organic solvent having a boiling point ranging from about 30° C. to 150° C., such as a lower alkyl acetate (e.g., ethyl acetate, butyl acetate) like ethyl propionate, secondary butyl alcohol, methyl isobutyl ketone, $\beta$-ethoxyethylacetate, or methyl cellosolve acetate and then dispersed into a hydrophilic colloid. These high boiling organic solvents and low boiling organic solvents may also be used as a mixture of two or more.

On the other hand, there can be employed the dispersion methods utilizing polymers, as disclosed in JP-B-48-30494; JP-B-51-39853; JP-A-50-102334; JP-A-51-25133; JP-A-61-59943; Japanese Patent Application Nos. 61-187996 and 61-189771 (corresponding to JP-A-63-43903 and JP-A-63-44658, respectively); West German Patent 2,830,917; and U.S. Pat. No. 3,619,195.

When the couplers have an acidic group, such as carboxyl or sulfo group, they are introduced into a hydrophilic colloid as an alkaline aqueous solution.

In photographic light-sensitive materials of this invention, known discoloration inhibitors can be used. Examples of such known discoloration inhibitors include hydroquinone derivatives, gallic acid derivatives, p-alkoxyphenols, p-oxyphenol derivatives, and bisphenols.

In addition to the various above-described additives, other additives can be used in the photographic materials relating to this invention, if desired.

These additives are described in detail in *Research Disclosure*, No. 17643 (Dec., 1978) and No. 8716 (Nov., 1979). The types of additives are described in the following Reference Table.

REFERENCE TABLE

| Kind of Additives | RD 17643 | RD 18716 |
|---|---|---|
| 1. Chemical Sensitizer | p. 23 | p. 648, right column |
| 2. Sensitivity Increasing Agent | | p. 648, right column |
| 3. Spectral Sensitizer Supersensitizer | pp. 23-24 | p. 648, from right column to p. 649, right column |
| 4. Brightening Agent | p. 24 | |
| 5. Antifoggant and Stabilizer | pp. 24-25 | p. 649, right column |
| 6. Light-Absorbent, Filter Dye, and Ultraviolet Absorbent | pp. 25-26 | p. 649, right column, and p. 650, left column |
| 7. Stain Inhibitor | p. 25, right column | p. 650, from left to right column |
| 8. Dye Image Stabilizer | p. 25 | |
| 9. Hardener | p. 26 | p. 651, left column |
| 10. Binder | p. 26 | p. 651, left column |
| 11. Plasticizer and Lubricant | p. 27 | p. 650, right column |
| 12. Coating Aid and Surface Active Agent | pp. 26-27 | p. 650, right column |
| 13. Antistatic Agent | p. 27 | p. 650, right column |

This invention is illustrated in more detail by reference to the following non-limiting examples. Unless otherwise indicated, all ratios and percentages are by weight.

EXAMPLE 1

A silver iodobromide gelatin emulsion (iodide content 1.5 mol %, average grain size: 0.9 μm) was chemically ripened by adding sodium thiosulfate and potassium chloroaurate. To the ripened emulsion was added the sodium salt of 3,3'-disulfopropyl-5,5'-dichloro-9-ethyl-oxacarbocyanine, followed by a stabilizer (4-hydroxy-6-methyl-1,3,3a,7-tetraazaindene), a coating aid (sodium dodecylbenzenesulfonate) and a hardener (2,4-dichloro-6-hydroxy-s-triazine). The thus obtained composition was coated on a cellulose triacetate film support, and dried. The resulting sample pieces were exposed for 1/20 sec. by means of a sensitometer through an optical wedge fitted with a yellow filter, and developed at 35° C. for 35 sec. using PQ developer described below, and PQ developers modified by the addition of compounds of the invention and comparative compounds as shown in Table 1. These samples were then fixed, washed, and dried in accordance with a transit method. The processed sample pieces were examined for photographic properties (including sensitivity and fog), and the results obtained are shown in Table 1.

The logarithm of the reciprocal of the exposure required for achieving the optical density of fog+0.02 was adopted in determining sensitivities. In Table 1, the sensitivities are shown as relative values, with Sample-1 being taken as 100.

| Composition of PQ Developer | |
|---|---|
| Sodium sulfite | 55.0 g |
| Hydroquinone | 28.0 g |
| Boric acid | 5.0 g |
| 1-Phenyl-3-pyrazolidone | 2.0 g |
| Potassium hydroxide (50% aqueous solution) | 20.0 g |
| 5-Methylbenzotriazole | 0.2 g |
| Glutaraldehyde bisulfite | 10.0 g |
| Acetic acid | 6.0 g |
| Potassium bromide | 3.0 g |
| Water to make | 1 l |

TABLE 1

| Sample | Compound | (Amount added to developer) | Fog | Relative Sensitivity |
|---|---|---|---|---|
| 1 | | — | 0.08 | 100 |
| 2 | Compound X-1 | (0.03 mol/l) | 0.09 | 125 |
| 3 | Compound X-2 | " | 0.08 | 131 |
| 4 | Compound X-3 | " | 0.09 | 130 |
| 5 | Compound X-4 | " | 0.08 | 129 |
| 6 | Compound X-6 | " | 0.08 | 128 |
| 7 | Compound X-14 | " | 0.09 | 125 |
| 8 | Compound X-17 | " | 0.08 | 129 |
| 9 | Compound x-18 | " | 0.09 | 130 |
| 10 | Comparative Compound (a) | " | 0.09 | 102 |
| 11 | Comparative Compound (a) | (0.06 mol/l) | 0.13 | 115 |
| 12 | Comparative Compound (b) | (0.03 mol/l) | 0.09 | 104 |
| 13 | Comparative Compound (b) | (0.06 mol/l) | 0.16 | 117 |

Comparative Compound (a):

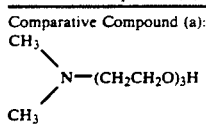

Comparative Compound (b):

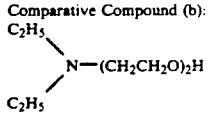

As can be seen from the data shown in Table 1, the compounds of this invention had a great effect on development acceleration and, what is more, this caused little fog, compared with comparative compounds (a) and (b). In contrast with the compounds of the invention, the comparative compounds increased fog as amount added increased.

EXAMPLE 2

To an aqueous solution of gelatin kept at 50° C., an aqueous solution of silver nitrate and an aqueous solution of potassium iodide and potassium bromide were added at the same time over a 60-minute period in the presence of $4\times10^{-7}$ mol/mol Ag of potassium hexachloroiridate(III) and ammonia. During the course of the addition, the pAg of the reaction system was kept at 7.8. Thus, a monodisperse cubic silver iodobromide emulsion having an average grain size of 0.28 μm and an average iodide content of 0.3 mol % was prepared. This emulsion was desalted using the flocculation process, and 40 g of inert gelatin added to it per mole of silver. After this, the emulsion was kept at 50° C., and 5,5'-dichloro-9-ethyl-3,3'-bis(3-sulfopropyl)oxacarbocyanine as a sensitizing dye and $10^{-3}$ mol/mol Ag of a KI solution were added to it. After a lapse of 15 minutes, the temperature of the emulsion was lowered.

The resulting emulsion was again dissolved, and kept at 40° C. To it, were added 0.02 mol/mol Ag of methylhydroquinone, a sensitizing dye having the following structural formula;

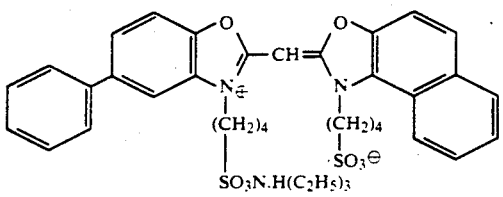

$1.2\times10^{-3}$ mol/mol Ag of a hydrazine derivative having the following structural formula;

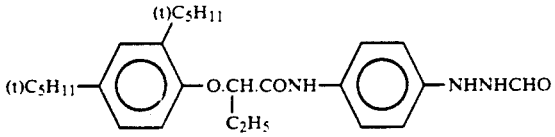

$0.5\times10^{-4}$ mol/mol Ag of the following compound;

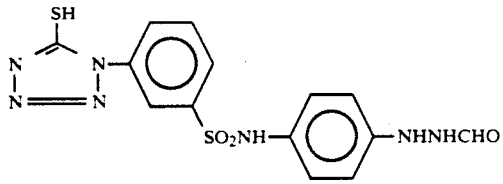

5-methylbenzotriazole; 4-hydroxy-6-methyl-1,3,3a,7-tetraazaindene; the following compounds (a) and (b);

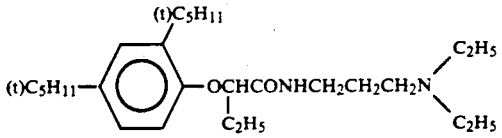

(a)

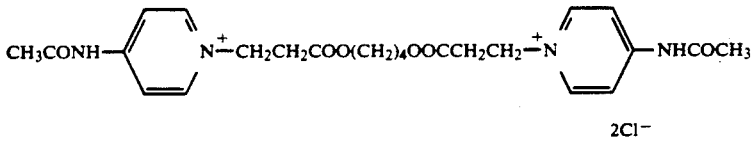

(b)

a polyethylacrylate dispersion, and compound (c) illustrated below as a hardener;

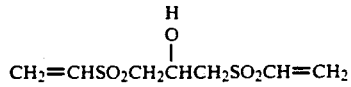

(c)

The resulting emulsion was coated on a polyethylene terephthalate film so that the silver coverage was 3.4 g/m². On this emulsion layer was simultaneously coated the following: a protective layer containing 1.5 g/m² of gelatin; 50 mg/m² of polymethylmethacrylate having a particle size of 2.5 μm; 0.15 g/m² of methanol silica; and the fluorine-containing surface active agent represented by the structural formula,

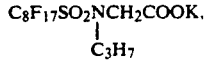

and sodium dodecylbenzenesulfonate as coating aids. The thus obtained film was named Film A.

Film A was subjected to exposure through a 150-line magenta contact screen and an optical wedge for sensitometry use; developed at 34° C. for 30 sec using the developers described below; fixed; washed; and dried. These processings were carried out with an FG 660F auto processor produced by Fuji Photo Film Co., Ltd.

The developers used were the developer A shown in Table 2 and those prepared by adding compounds of the invention or comparative compounds to this developer in the amounts set forth in Table 3.

Every developer tested was replenished at a ratio of 100 ml for each processing of overall exposed film having the area equal to one-half the Daizen-size (50.8 cm×61.0 cm); 200 sheets of this film were processed every day. After the processing had gone on for 5 days, the last processed film was examined for photographic properties and the extent of silver stain.

Photocomposing paper PL-200 WP, produced by Fuji Photo Film Co., Ltd., was subjected to development, fixation, washing and drying processings in the same manner as described above in order to compare the amount of color stain or a paper support-utilizing silver halide photographic material.

In Table 3, the sensitivities are shown as relative values, where the reciprocal of an exposure required for obtaining a density of 1.5 when Film A was processed with the developer prepared by adding 0.17 mol/l of a comparative compound (c) to Developer A was taken as 100.

$\overline{G}$ represents a gradient (tan θ) of the straight line connecting the point of density=0.3 and the point of density=3.0 on the characteristic curve of each sample. The halftone dot quality was evaluated in five grades by observation with the naked eye. In this five-grade evaluation, "5" represents the best quality, and "1" the worst quality. The grades "5" and "4" are on the level practically usable as a halftone original in the graphic arts, the grade "3" is on a barely usable level, and the grades "2" and "1" are below the practically usable level.

The silver stain was also evaluated in five grades, wherein the grade "5" referred to such a condition that no silver stain was generated on a film measuring 9.0 cm by 25.0 cm, and the grade "1" referred to such a condition that silver stain was generated all over the film. The grade "4" is on the practically usable level, though silver stain was generated on the film in a very small area, whereas the grade "3" and the lower are unusable.

The color stain on the silver halide photographic material using a paper support, PL·200 WP, was evaluated in three ranks described below by observation with the naked eye.

| | |
|---|---|
| ○ | Color stain is inconspicuous. |
| Δ | Color stain is somewhat conspicuous. |
| x | Color stain is so great that the processed material is without commercial value. |

The results obtained are shown in Table 3.

TABLE 2

| Composition of Developer A: | |
|---|---|
| Hydroquinone | 50.0 g |
| N-Methyl-p-aminophenol | 0.3 g |
| Sodium hydroxide | 18.0 g |
| 5-Sulfosalicylic acid | 45.0 g |
| Boric acid | 10.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| 3-(5-Mercaptotetrazole)benzenesulfonic acid | 0.2 g |
| Sodium p-toluenesulfonate | 15.0 g |
| Water to make | 1 l |
| pH adjusted (with KOH) to | 11.6 |

TABLE 3

| | | Capabilities of Fresh Developer | | | | | Capabilities of Developer used for 1000 sheets 5-day running processing | | | | |
|---|---|---|---|---|---|---|---|---|---|---|---|
| Amine Compound added to Developer | Photographic Material used | Sensitivity | $\bar{G}$ | Halftone Quality | Silver Stain | Color Stain | Sensitivity | $\bar{G}$ | Halftone Quality | Silver Stain | Color Stain |
| Not added | Film A | 40 | 6 | 2 | 5 | ○ | 40 | 6 | 2 | 5 | ○ |
| | PL · 200 WP | | | | 5 | ○ | | | | 5 | ○ |
| Comparative | Film A | 45 | 7 | 2 | 5 | ○ | 45 | 7 | 2 | 5 | ○ |
| Compound (a) | PL · 200 WP | | | | 5 | ○ | | | | 5 | ○ |
| 0.03 ml/l | | | | | | | | | | | |
| Comparative | Film A | 60 | 9 | 3 | 5 | ○ | 61 | 9 | 3 | 5 | ○ |
| Compound (b) | PL · 200 WP | | | | 5 | ○ | | | | 5 | ○ |
| 0.03 ml/l | | | | | | | | | | | |
| Comparative | Film A | 60 | 9 | 3 | 5 | ○ | 60 | 9 | 3 | 4 | ○ |
| Compound (c) | PL · 200 WP | | | | 5 | ○ | | | | 4 | ○ |
| 0.03 ml/l | | | | | | | | | | | |
| Comparative | Film A | 100 | 18 | 5 | 5 | ○ | 100 | 18 | 5 | 3 | ○ |
| Compound (c) | PL · 200 WP | | | | 5 | Δ | | | | 3 | Δ |
| 0.17 ml/l | | | | | | | | | | | |
| Comparative | Film A | 75 | 10 | 3 | 5 | ○ | 74 | 10 | 3 | 5 | ○ |
| Compound (d) | PL · 200 WP | | | | 5 | Δ | | | | 5 | Δ |
| 0.03 ml/l | | | | | | | | | | | |
| Comparative | Film A | 100 | 18 | 5 | 5 | ○ | 100 | 18 | 5 | 5 | ○ |
| Compound (d) | PL · 200 WP | | | | 5 | X | | | | 5 | X |
| 0.10 ml/l | | | | | | | | | | | |
| X-2 | Film A | 106 | 19 | 5 | 5 | ○ | 106 | 19 | 5 | 5 | ○ |
| 0.03 ml/l | PL · 200 WP | | | | 5 | ○ | | | | 5 | ○ |
| X-1 | Film A | 99 | 18 | 5 | 5 | ○ | 99 | 18 | 5 | 5 | ○ |
| 0.03 ml/l | PL · 200 WP | | | | 5 | ○ | | | | 5 | ○ |
| X-3 | Film A | 101 | 18 | 5 | 5 | ○ | 101 | 18 | 5 | 5 | ○ |
| 0.03 ml/l | PL · 200 WP | | | | 5 | ○ | | | | 5 | ○ |
| X-14 | Film A | 98 | 18 | 5 | 5 | ○ | 99 | 18 | 5 | 5 | ○ |
| 0.03 ml/l | PL · 200 WP | | | | 5 | ○ | | | | 5 | ○ |
| X-18 | Film A | 105 | 19 | 5 | 5 | ○ | 106 | 19 | 5 | 5 | ○ |

TABLE 3-continued

| Amine Compound added to Developer | Photographic Material used | Capabilities of Fresh Developer: Sensitivity | $\bar{G}$ | Halftone Quality | Silver Stain | Color Stain | Capabilities of Developer used for 1000 sheets 5-day running processing: Sensitivity | $\bar{G}$ | Halftone Quality | Silver Stain | Color Stain |
|---|---|---|---|---|---|---|---|---|---|---|---|
| 0.03 ml/l | PL - 200 WP | | | | 5 | ○ | | | | 5 | ○ |

Comparative Compound (a):

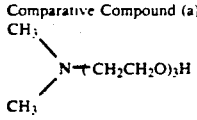

Comparative Compound (b):

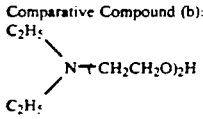

Comparative Compound (c):

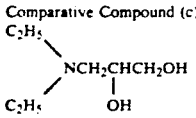

Comparative Compound (d):

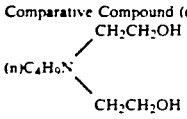

Among the comparative amino compounds, as can be seen from the data in Table 3, comparative compound (c) disclosed in U.S. Pat. No. 4,269,929 caused serious silver stain in processing with the running solution and rather marked color stain in processing the photographic material using paper as a support; the comparative compound (d) disclosed in JP-A-61-267759 caused no silver stain in processing with the running solution, but serious color stain in processing the photographic material using paper as a support; and the comparative compounds (a) and (b), which are analogous to the amino compounds of the invention, did not able to ensure satisfactory sensitivity.

In contrast with these results, the amino compounds of the invention gave most desirable results: they caused neither silver stain nor color stain. That is, in accordance with this invention, the photographic material containing a hydrazine compound has high sensitivity and high gamma, provides halftone dots of high quality, and prevents silver stain from forming in processing with a running solution; and, more significantly, when the photographic material using paper as a support is processed with the same developer as the above-described photographic material, no color stain results.

EXAMPLE 3

To an aqueous solution of gelatin kept at 50° C. were added simultaneously an aqueous solution of silver nitrate and an aqueous solution of sodium chloride in the presence of $5.0\times10^{-6}$ mol/mol Ag of $(NH_4)_3RhCl_6$. After the completion of the reaction, the soluble salt was removed from the emulsion, gelatin was added, and then 2-methyl-4-hydroxy-1,3,3a,7-tetraazaindene was added as a stabilizer without carrying out any chemical sensitization. Thus, a monodisperse cubic silver chloride emulsion having an average grain size of 0.15 μm was obtained (Emulsion B).

To this emulsion were added, in sequence, the following hydrazine compound;

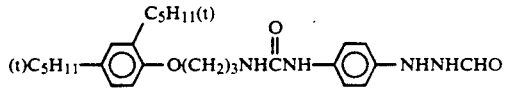

15 mg/mg

Dye-1 illustrated below:

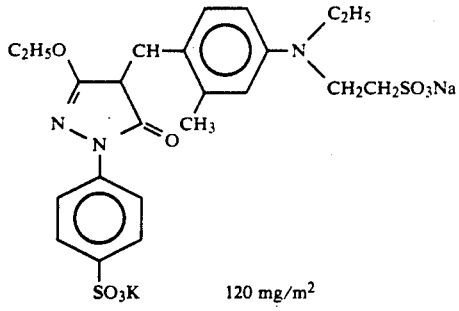

120 mg/m² each of the compounds of the invention set forth in Table 4, and 1,3-vinylsulfonyl-2-propanol as a hardener. The resulting composition was coated on a polyester support to give a coverage of 3.4 g/m² based on silver. The gelatin coverage was 2.5 g/m².

On this coat, protective layer (1) and a protective layer (2) were provided, in that order. Both protective layers are described below.

| | |
|---|---|
| Protective Layer (1): | |
| Gelatin | 1.0 g/m² |
| Lipoic acid | 5 mg/m² |
| Sodium dodecylbenzenesulfonate | 5 mg/m² |
| Dye-2 | 20 mg/m² |
| Sodium polystyrenesulfonate | 10 mg/m² |
| Dye-3 | 20 mg/m² |
| Ethylacrylate latex (average size: 0.05 μm) | 200 mg/m² |
| Protective Layer (2): | |
| Gelatin | 1.0 g/m² |
| Matting agent (polymethylmethacrylate | 50 mg/m² |

-continued

| | |
|---|---|
| particles, average size: 2.5 μm) | |
| Sodium dodecylbenzenesulfonate | 20 mg/m$^2$ |
| Potassium perfluorooctanesulfonate | 10 mg/m$^2$ |
| Potassium N-perfluorooctanesulfonyl-N-propylglycin | 2 mg/m$^2$ |

Dye-2

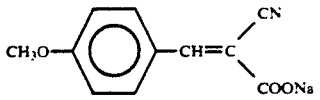

Dye-3

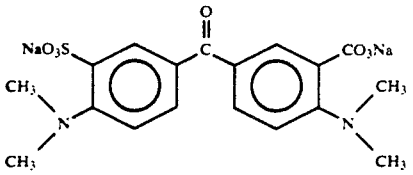

The resulting samples were each exposed by means of a P-607 daylight printer, produced by Dainippon Screen Mfg. Co., Ltd., and developed at 38° C. for 20 sec using the developer described below; fixed, washed, and dried.

| Composition of Developer: | |
|---|---|
| Hydroquinone | 50.0 g |
| N-Methyl-p-aminophenol | 0.3 g |
| Sodium hydroxide | 18.0 g |
| 5-Sulfosalicylic acid | 30.0 g |
| Boric acid | 20.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene-sulfonate | 0.2 g |
| 6-Dimethylamino-1-hexanol | 4.0 g |
| Sodium toluenesulfonate | 15.0 g |
| Water to make | 1 l |
| pH adjusted (with KOH) to | 11.7 |

The results obtained are shown in Table 4.

TABLE 4

| Sample No. | Compound of Formula (X') Compound No. | Amount added | Relative Sensitivity (S) | Gradation ($\bar{G}$) |
|---|---|---|---|---|
| 3-1 | — | — | 100 | 11.5 |
| 3-2 | Comparative compound (b) | 2.0 × 10$^{-5}$ mol/m$^2$ | 110 | 11.8 |
| 3-3 | Comparative compound (c) | 2.0 × 10$^{-5}$ mol/m$^2$ | 112 | 12.6 |
| 3-4 | Comparative compound (d) | 2.0 × 10$^{-5}$ mol/m$^2$ | 116 | 13.1 |
| 3-5 | Comparative compound (e) | 2.0 × 10$^{-5}$ mol/m$^2$ | 125 | 14.1 |
| 3-6 | X'-1 | 2.0 × 10$^{-5}$ mol/m$^2$ | 129 | 14.7 |
| 3-7 | X'-4 | 2.0 × 10$^{-5}$ mol/m$^2$ | 134 | 14.9 |
| 3-8 | X'-5 | 2.0 × 10$^{-5}$ mol/m$^2$ | 142 | 16.3 |
| 3-9 | X'-8 | 2.0 × 10$^{-5}$ mol/m$^2$ | 137 | 15.4 |
| 3-10 | X'-9 | 2.0 × 10$^{-5}$ mol/m$^2$ | 145 | 16.5 |
| 3-11 | X'-10 | 2.0 × 10$^{-5}$ mol/m$^2$ | 139 | 15.2 |

TABLE 4-continued

| Sample No. | Compound of Formula (X') Compound No. | Amount added | Relative Sensitivity (S) | Gradation ($\bar{G}$) |
|---|---|---|---|---|
| | | mol/m$^2$ | | |

Comparative Compound (b):

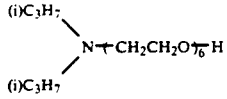

Comparative Compound (c):

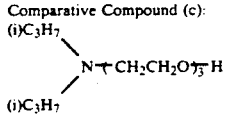

Comparative Compound (d):

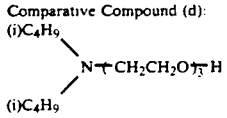

Comparative Compound (e):

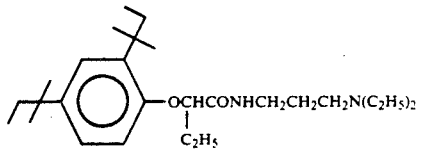

Note:
The above-illustrated comparative compounds (b), (c) and (d) are disclosed in EP-A-0364166.

As can be seen from Table 4, the samples of this invention had high sensitivities and high gradations (G). It is apparent that the compounds of the invention were particularly superior in effectiveness to the comparative compounds (b), (c) and (d) disclosed in EP-A-0364166.

The sample, the photographic materials were then subjected to forced ageing under conditions of high temperature and humidity, and examined for change in photographic characteristics. More specifically, each sample, from 3-1 to 3-11, was allowed to stand for 3 days at 50° C.-65% RH, and processed in the same manner as in the above-described test. Rates of changes in relative sensitivity and gradation were then determined. The results obtained are shown in Table 5.

TABLE 5

| Sample No. | Change Rate upon Forced Ageing ΔS % | Δ$\bar{G}$ % |
|---|---|---|
| 3-1 | −2 | −8 |
| 3-2 | +4 | +10 |
| 3-3 | +5 | +12 |
| 3-4 | +4 | +12 |
| 3-5 | +5 | +16 |
| 3-6 | +2 | +5 |
| 3-7 | +3 | +4 |
| 3-8 | +1 | +5 |
| 3-9 | +2 | +5 |
| 3-10 | +3 | +5 |
| 3-11 | +1 | +4 |

As can be seen from Table 5, the comparative samples, from 3-2 to 3-5, were undesirable because they had great rates of change. In contrast the samples of the present invention (3-6 to 3-11) all showed small rates of change.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material comprising:

processing an imagewise exposed silver halide photographic material using a developer containing at least one compound represented by general formula (X):

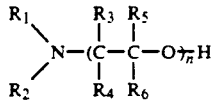

(X)

wherein $R_1$ and $R_2$ each represents a hydrogen atom, a substituted or unsubstituted alkyl group containing from 2 to 8 carbon atoms, a substituted or unsubstituted alkenyl group containing from 3 to 8 carbon atoms, or a substituted or unsubstituted aralkyl group containing from 7 to 12 carbon atoms, provided that $R_1$ and $R_2$ are not both hydrogen atoms, the substituents for the substituted alkyl, alkenyl and aralkyl groups represented by $R_1$ and $R_2$ are selected from the group consisting of a halogen atom, a cyano group, a nitro group, a hydroxyl group, an alkoxy group, an aryloxy group, an alkylthio group, an arylthio group, an acyloxy group, an amino group, a carbonamido group, a sulfonamido group, an oxycarbonylamino group, an ureido group, a thioureido group, an acyl group, an oxycarbonyl group, a carbamoyl group, a sulfonyl group, a sulfamoyl group, a carboxylate group, and a sulfonate group; or $R_1$ and $R_2$ are combined to form a ring;

$R_3$, $R_4$, $R_5$, and $R_6$ each represents a hydrogen atom or an alkyl group containing from 1 to 4 carbon atoms; and n represents an integer from 3 to 20.

2. A method for processing a silver halide photographic material as claimed in claim 1, wherein $R_1$ and $R_2$ each represents an alkyl group containing from 2 to 4 carbon atoms;

$R_3$, $R_4$, $R_5$, and $R_6$ each represents a hydrogen atom; and n represents an integer from 3 to 5.

3. A method for processing a silver halide photographic material as claimed in claim 1, wherein said compound (X) is present in an amount of from 0.005 to 0.3 mol/liter of developer.

4. A method for processing a silver halide photographic material as claimed in claim 1, wherein said compound (X) is present in an amount of from 0.01 to 0.2 mol/liter of developer.

5. A method for processing a silver halide photographic material as claimed in claim 1, wherein said developer further comprises a compound represented by general formula (Y) or (Z):

$$R_7—SO_3M \quad (Y)$$

$$R_8—COOM \quad (Z)$$

wherein

M represents a hydrogen atom, Na, K, or $NH_4$; and $R_7$ and $R_8$ each represents an alkyl group containing at least 3 carbon atoms, an alkylbenzene residue, or a benzene residue.

6. A method for processing a silver halide photographic material as claimed in claim 1, wherein said imagewise exposed silver halide photographic material is developed in the presence of hydrazine derivatives represented by general formula (I):

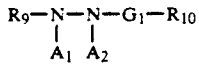

(I)

wherein $R_9$ represents an aliphatic group, or an aromatic group; $R_{10}$ represents a hydrogen atom, an alkyl group, an aryl group, an alkoxy group, an aryloxy group, an amino group, a hydrazino group, a carbamoyl group, or an oxycarbonyl group; $G_1$ represents a carbonyl group, a sulfonyl group, a sulfoxy group,

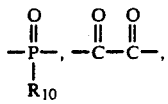

a thiocarbonyl group, or an iminomethylene group; and both $A_1$ and $A_2$ represent a hydrogen atom, or one of them is a hydrogen atom and the other represents a substituted or unsubstituted alkylsulfonyl group, a substituted or unsubstituted arylsulfonyl group, or a substituted or unsubstituted acyl group.

7. A method for processing a silver halide photographic material as claimed in claim 1, wherein $R_1$ and $R_2$ each represents an alkyl group containing from 2 to 8 carbon atoms.

8. A method for processing a silver halide photographic material as claimed in claim 1, wherein the substituent for $R_1$ or $R_2$ is an alkylthio group or an amino group.

9. A method for processing a silver halide photographic material as claimed in claim 1, wherein $R_1$ and $R_2$ each represents an aryalkyl group.

10. A method for processing a silver halide photographic material as claimed in claim 1, wherein $R_1$ and $R_2$ each represents an alkenyl group.

11. A developer for processing a silver halide photographic material comprising at least one compound represented by general formula (X):

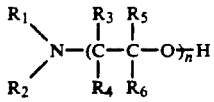

(X)

wherein $R_1$ and $R_2$ each represents a hydrogen atom, a substituted or unsubstituted alkyl group containing from 2 to 8 carbon atoms, a substituted or unsubstituted alkenyl group containing from 3 to 8 carbon atoms, or a substituted or unsubstituted aralkyl group containing from 7 to 12 carbon atoms, provided that $R_1$ and $R_2$ are not both hydrogen atoms, the substituents for the substituted alkyl, alkenyl and aralkyl groups represented by $R_1$ and $R_2$ are selected from the group consisting of a halogen atom, a cyano group, a nitro group, a hydroxyl group, an alkoxy group, an aryloxy group, an alkylthio group, an arylthio group, an acyloxy group, an amino group, a carbonamido group, a sulfonamido group, an oxycarbonylamino group, an ureido group, a thioureido group, an acyl group, an oxycarbonyl group, a carbamoyl group, a sulfonyl group, a sulfamoyl group, a carboxylate group, and a sulfonate group; or $R_1$ and $R_2$ are combined to form a ring;

$R_3$, $R_4$, $R_5$, and $R_6$ each represents a hydrogen atom or an alkyl group containing from 1 to 4 carbon atoms; and n represents an integer from 3 to 20.

12. A developer for processing a silver halide photographic material as claimed in claim 11, wherein $R_1$ and $R_2$ each represents an alkyl group containing from 2 to 4 carbon atoms;

$R_3$, $R_4$, $R_5$, and $R_6$ each represents a hydrogen atom; and n represents an integer from 3 to 5.

13. A developer for processing a silver halide photographic material as claimed in claim 11, wherein said compound (X) is present in an amount of from 0.005 to 0.3 mol/liter of said developer.

14. A developer for processing a silver halide photographic material as claimed in claim 11, wherein said compound (X) is present in an amount of from 0.01 to 0.2 mol/liter of said developer.

15. A developer for processing a silver halide photographic material as claimed in claim 11, wherein said developer further comprises a compound represented by general formula (Y) or (Z):

$$R_7—SO_3M \quad (Y)$$

$$R_8—COOM \quad (Z)$$

M represents a hydrogen atom, Na, K, or $NH_4$; and $R_7$ and $R_8$ each represents an alkyl group containing at least 3 carbon atoms, an alkylbenzene residue, or a benzene residue.

* * * * *